US010731340B2

(12) United States Patent
Stramandinoli et al.

(10) Patent No.: US 10,731,340 B2
(45) Date of Patent: Aug. 4, 2020

(54) SYSTEM FOR CLOSING OPENINGS IN BUILDINGS AND BUILDING STRUCTURES IN GENERAL, AND CORRESPONDING COVERING KIT

(71) Applicant: Giugiaro Architettura & Structures S.r.l., Colognola ai Colli VR. (IT)

(72) Inventors: Giovanni Stramandinoli, Claviere (IT); Sergio De Simone, Bolzano (IT)

(73) Assignee: Giugiaro Architettura & Structures S.r.l., Colognola ai Colli VR (IT)

( * ) Notice: Subject to any disclaimer, the term of this patent is extended or adjusted under 35 U.S.C. 154(b) by 0 days.

(21) Appl. No.: 16/180,841

(22) Filed: Nov. 5, 2018

(65) Prior Publication Data

US 2019/0136522 A1 May 9, 2019

(30) Foreign Application Priority Data

Nov. 6, 2017 (IT) ..... 102017000125946

(51) Int. Cl.

| | |
|---|---|
| ***E04B 2/96*** | (2006.01) |
| ***E04B 1/41*** | (2006.01) |
| ***E04F 13/08*** | (2006.01) |
| *E06B 1/34* | (2006.01) |

(52) U.S. Cl.

CPC ..... *E04B 2/96* (2013.01); *E04B 1/40* (2013.01); *E04B 2/967* (2013.01); *E04F 13/0801* (2013.01); *E06B 1/342* (2013.01)

(58) Field of Classification Search

CPC ..... E04B 2/96; E04B 1/40

See application file for complete search history.

(56) References Cited

U.S. PATENT DOCUMENTS 5,355,645 A * 10/1994 Farag ..... E04B 2/96 52/235
5,579,616 A * 12/1996 Farag ..... E04B 2/96 52/204.5
7,676,999 B2 * 3/2010 Arias ..... E06B 3/5427 292/175
8,534,012 B2 * 9/2013 Wood ..... E06B 1/34 52/211

(Continued)

FOREIGN PATENT DOCUMENTS

EP 2 444 565 4/2012

OTHER PUBLICATIONS

Search Report of Italian Application No. IT 201700125946, dated Jun. 27, 2018, 8 pages.

*Primary Examiner* — Paola Agudelo
(74) *Attorney, Agent, or Firm* — Nixon & Vanderhye P.C.

(57) ABSTRACT

A system for closing openings in a building comprises:

at least one structural frame having at least two lateral uprights (11*a*) and two end cross members, coupled to form a perimetral structure that delimits a space, at least one infill element associated to the structural frame at a front thereof, for closing the space delimited by the perimetral structure, at least one longitudinally extending covering element (21*b*), configured for being mounted on the structural frame at a back thereof, a magnetic-coupling arrangement (24, 28), for constraining in a magnetic way the at least one covering element (21*a*) in at least one first region of an upright (11*a*) or a cross member of the structural frame.

20 Claims, 20 Drawing Sheets

(56) References Cited

U.S. PATENT DOCUMENTS

2005/0284053 A1* 12/2005 Grunewald ..... E04B 2/96
52/235
2006/0213139 A1* 9/2006 Stramandinoli ..... E04B 2/885
52/384
2011/0167743 A1* 7/2011 Ting ..... E04B 2/96
52/235
2012/0272605 A1* 11/2012 Huang ..... E04B 2/96
52/483.1
2014/0208669 A1* 7/2014 Weinryb ..... E06B 3/6715
52/172
2014/0298740 A1* 10/2014 Ting ..... E04B 2/90
52/302.1
2014/0311067 A1* 10/2014 Criaud ..... E04B 2/7455
52/235
2015/0284950 A1* 10/2015 Stramandinoli ..... E04B 2/90
52/235

* cited by examiner

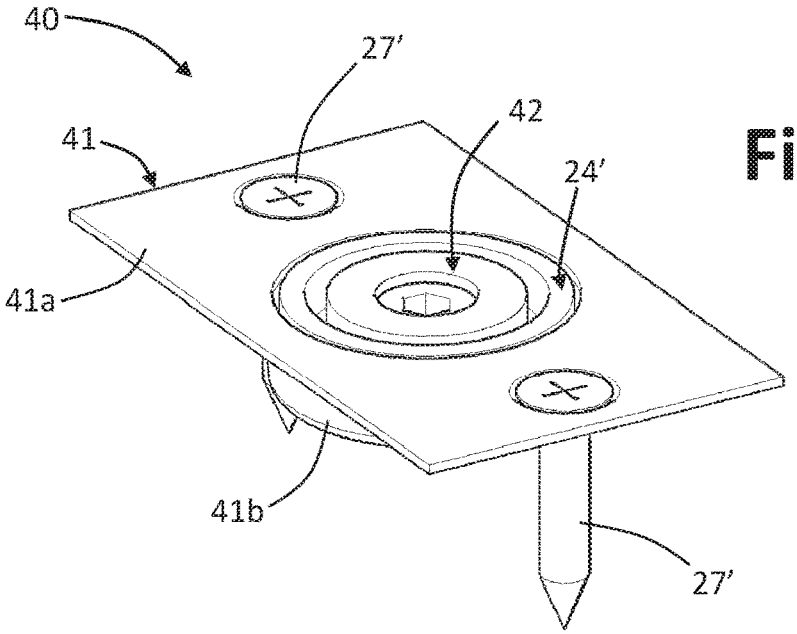
Fig. 15
Fig. 16
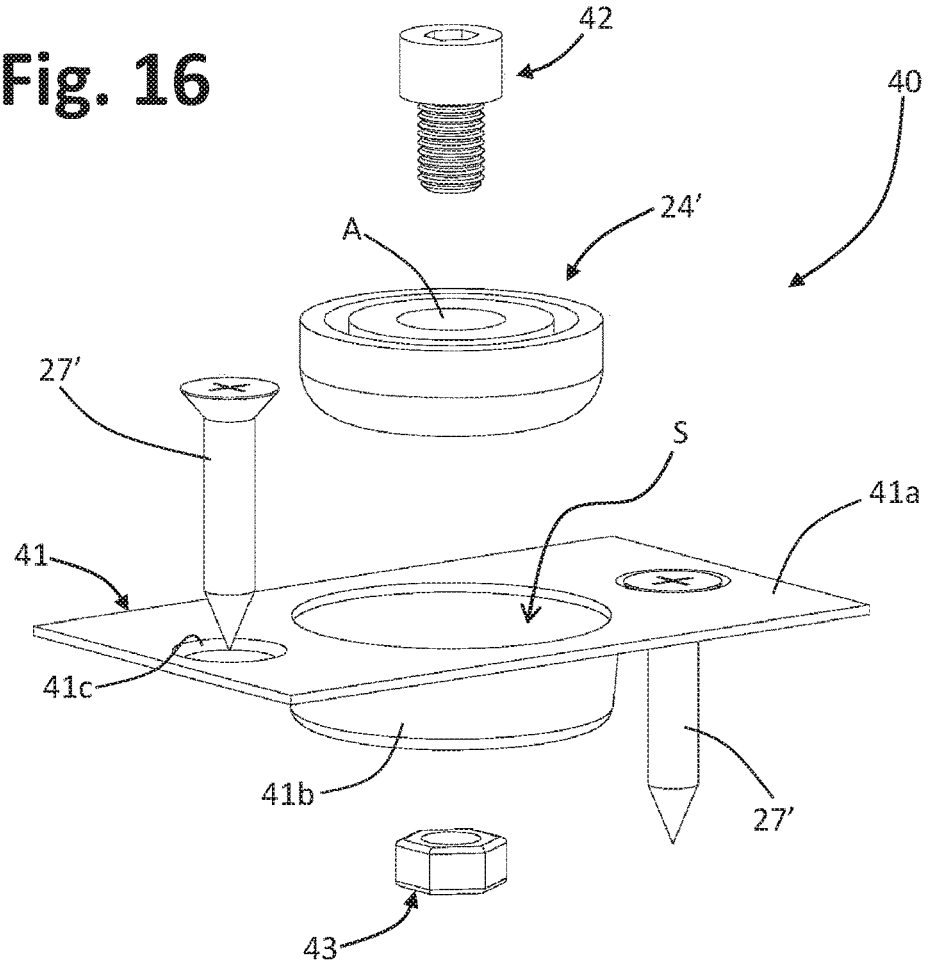

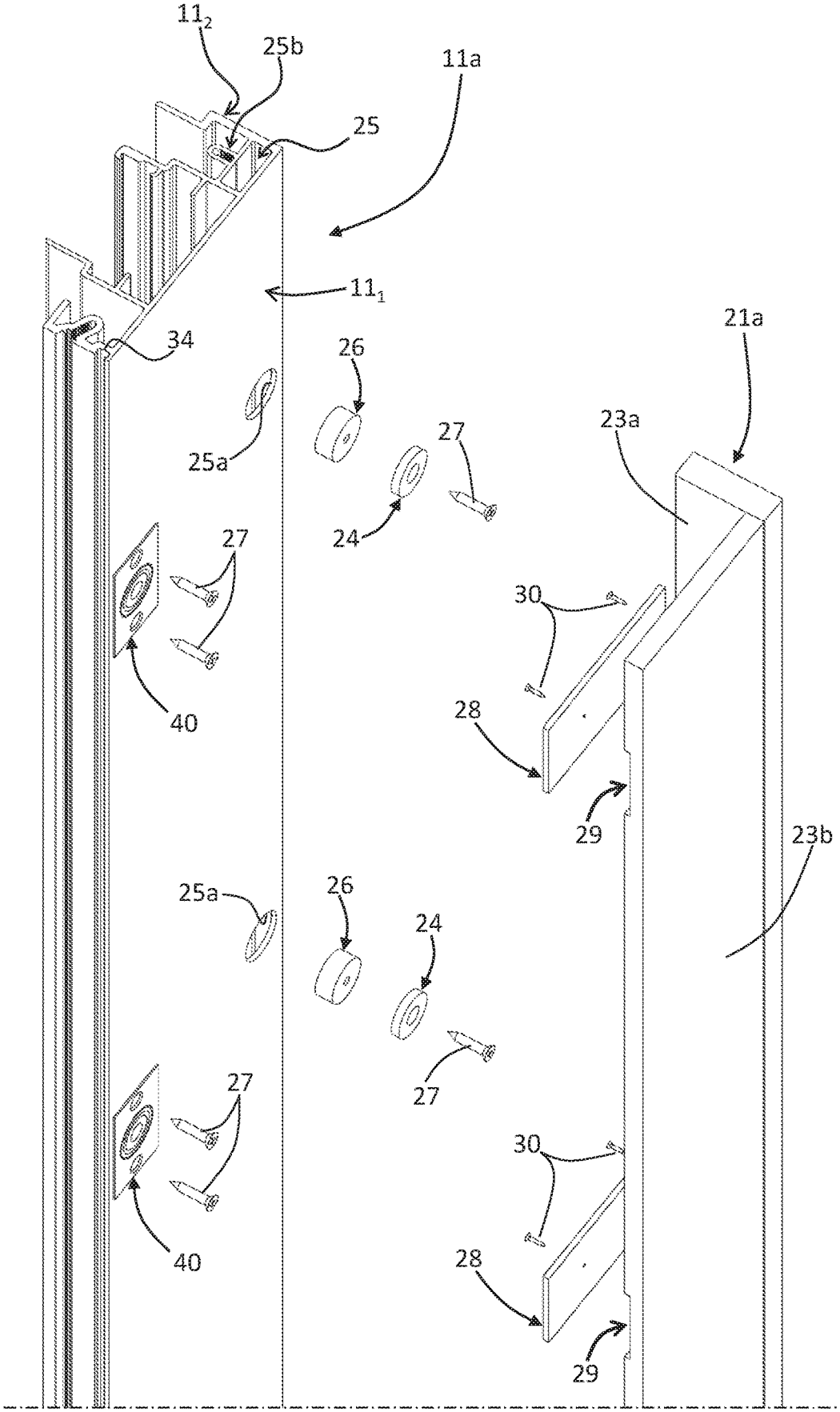
$11_2$
25b
11a
25
$11_1$
34
26
21a
25a
27
23a
24
27
30
40
28
29
23b
25a
26
24
27
27
30
40
28
29

SYSTEM FOR CLOSING OPENINGS IN BUILDINGS AND BUILDING STRUCTURES IN GENERAL, AND CORRESPONDING COVERING KIT

This application claims priority to IT Patent Application No. 102017000125946 filed Nov. 6, 2017, the entire contents of each of which is hereby incorporated by reference.

FIELD OF THE INVENTION

The present invention relates to systems for closing openings in buildings and building structures in general, and has been developed with particular reference to prefabricated cells used for providing curtain walls and the like. The invention may, on the other hand, be applied also in combination to door and window frames of different types.

PRIOR ART

In the current state of the art it is known to provide curtain-wall façades or structural façades using purposely provided panel elements, known as "cells", which are pre-assembled in the production site and then installed in the building site.

These cells are individually associated to a load-bearing structure of the building, typically represented by its floors, independently of one another, so as to enable the necessary settling of the façades due to thermal expansions and/or to occasional seismic movements, without this causing failure of the parts that make up the various cells. The cells once mounted provide a sort of curtain wall, which closes the spaces existing between the various floors at a respective side of the building.

The cells have in general a metal structural frame, which delimits a space that can be closed via infill elements. The frame is usually formed by a plurality of aluminum sectional elements, and the infill elements may be of a transparent or else blind type, and may be fixed or else openable, according to the requirements.

The cells according to the known technique are on average satisfactory, but the part of their frame directly in view inside the building is frequently rather poor from the aesthetic standpoint, even when the sectional elements that make up the frame present a good surface finish.

This problem may be overcome by employing solutions where the frame of each cell is made practically entirely of wood, preferably laminated wood, and hence with an improved aesthetic appearance. This type of solution presents, however, the drawback that the frames of the cells are particularly subject to possible damage, both while they are being transported onto the building site and during their installation, as well as in stages subsequent to their installation.

In fact, also in the case where transport is carried out with particular care and using suitable protective packaging, at the moment of installation the cells must be hoisted or lowered with respect to the floors of the building that is being erected and then secured thereto, for example via purposely provided suspension devices. It will be understood that, during these installation steps, any possible contact or sliding of the wooden frame against a floor (which is generally made of reinforced concrete or steel) may cause significant surface damage, in particular on the part of the frame that will come to be directly in view inside the building.

It is also to be considered that, for constructional requirements, mounting of a curtain wall of the type referred to is in general carried out in an initial step of erection of the building, i.e., a little after the floors have been laid, in order to delimit peripherally the spaces between the floors themselves. Installation of the curtain wall is then followed by the further internal works necessary for completion of the building, such as provision of wiring and plumbing systems, creation of partition walls, laying of flooring, etc. Hence, even in the course of these subsequent works, the inner side of the wooden frames is subject to risks of damage. Risks of this type are, on the other hand, present also in the case of structural frames made of aluminum.

In addition to this, it is to be considered that the pre-arrangement of curtain walls of large dimensions (such as curtain walls of a sky scraper) cannot in general be completed just in one day. The consequence of this is that—after a partial mounting of the curtain wall—the inside of the frames may in any case be exposed to adverse atmospheric agents (such as prolonged rain), with consequent damage to the wooden structure of the cells.

Similar problems are encountered also in relation to other types of door or window frames.

SUMMARY OF THE INVENTION

In its general terms, the present invention aims at overcoming one or more of the drawbacks indicated above. In this general context, an aim of the invention is to provide a system for closing openings in buildings and building structures in general, in particular a curtain-wall or structural-façade system, that is simple to install, aesthetically pleasant, and substantially immune from the risks of damage exemplified previously. Another aim of the present invention is to provide a covering kit that make it possible to achieve the results indicated above in relation to various types of systems for closing openings in buildings and building structures in general, in particular but not exclusively curtain-wall or structural-façade systems.

One or more of the aforesaid aims are achieved, according to the present invention, by a system and a kit having the characteristics indicated in the attached claims.

BRIEF DESCRIPTION OF THE DRAWINGS

Further aims, characteristics, and advantages of the invention will emerge clearly from the ensuing detailed description, with reference to the annexed drawings, which are provided by way of explanatory and non-limiting example and in which:

FIG. 15 is a schematic perspective view of an adapter assembly belonging to a kit that can be used in embodiments of the invention;

FIG. 16 is a partially exploded view of the adapter assembly of FIG. 15;

FIGS. 21 and 22 are partial and schematic perspective views of parts of a structural frame forming part of a system according to further possible embodiments of the invention, with a corresponding covering element represented partially exploded.

DESCRIPTION OF EMBODIMENTS OF THE INVENTION

Reference to "an embodiment", "one embodiment", "various embodiments", and the like, in the course of this description is intended to indicate that at least one particular configuration, structure, or characteristic described in relation to one embodiment is comprised in at least one embodiment. Hence, phrases such as "in an embodiment", "in one embodiment", "in various embodiments", and the like that may be present in various points of this description do not necessarily refer to one and the same embodiment, but may instead refer to different embodiments. Moreover, particular conformations, structures, or characteristics defined in the course of this description may be combined in any adequate way in one or more embodiments, even different from the ones shown. The reference numbers and spatial references (such as "upper", "lower", "up", "down", "front", "back", "vertical", etc.) used herein, in particular with reference to the examples in the figures, are only provided for convenience and hence do not define the sphere of protection or the scope of the embodiments. In what follows only the elements useful for an understanding of the invention will be described. In the figures the same reference numbers are used to designate elements that are similar or technically equivalent to one another.

Figure 1:
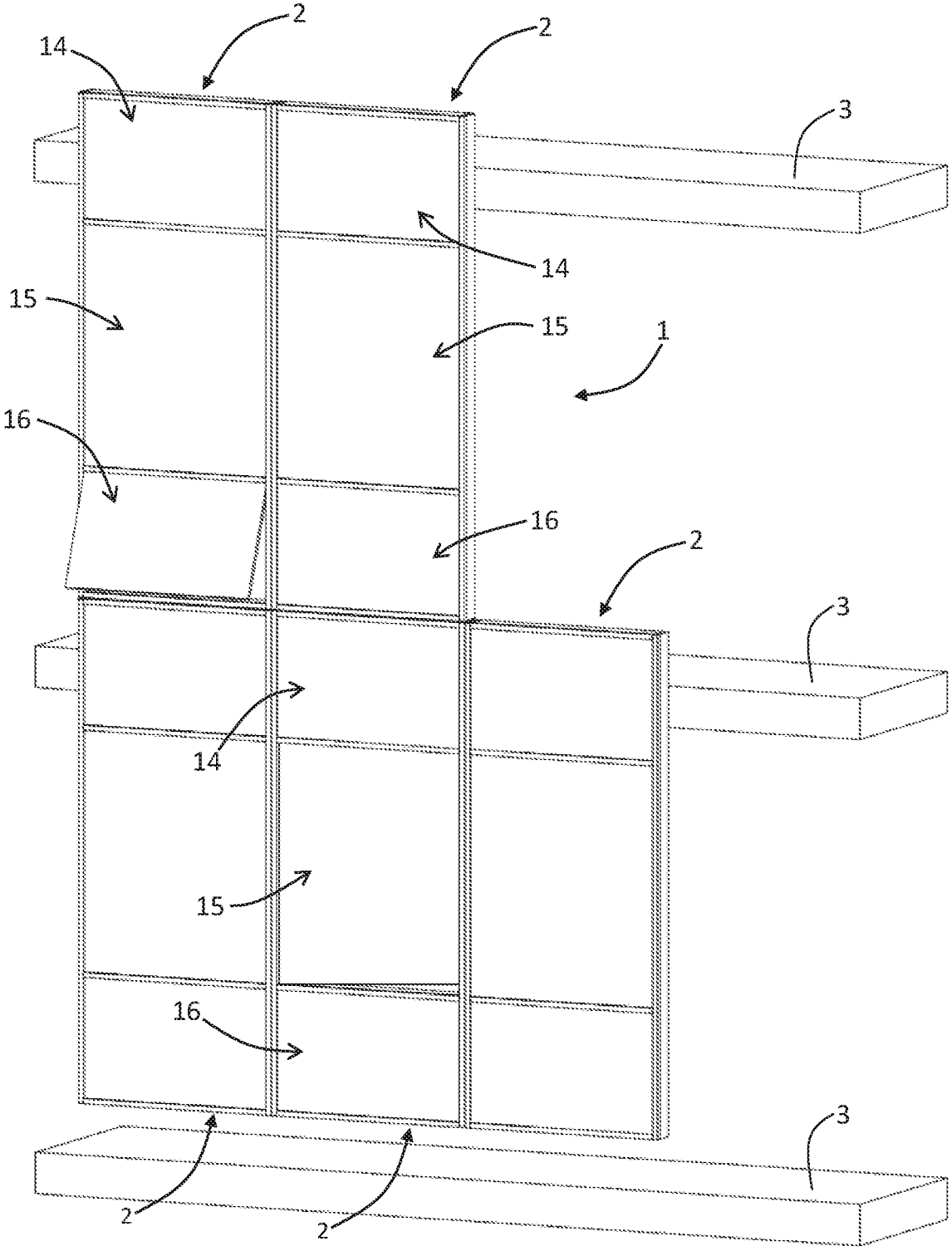
FIG. 1 is a schematic perspective view of a portion of a system for closing openings in buildings, in particular a curtain-wall system, provided according to possible embodiments of the invention.
Figure 2:
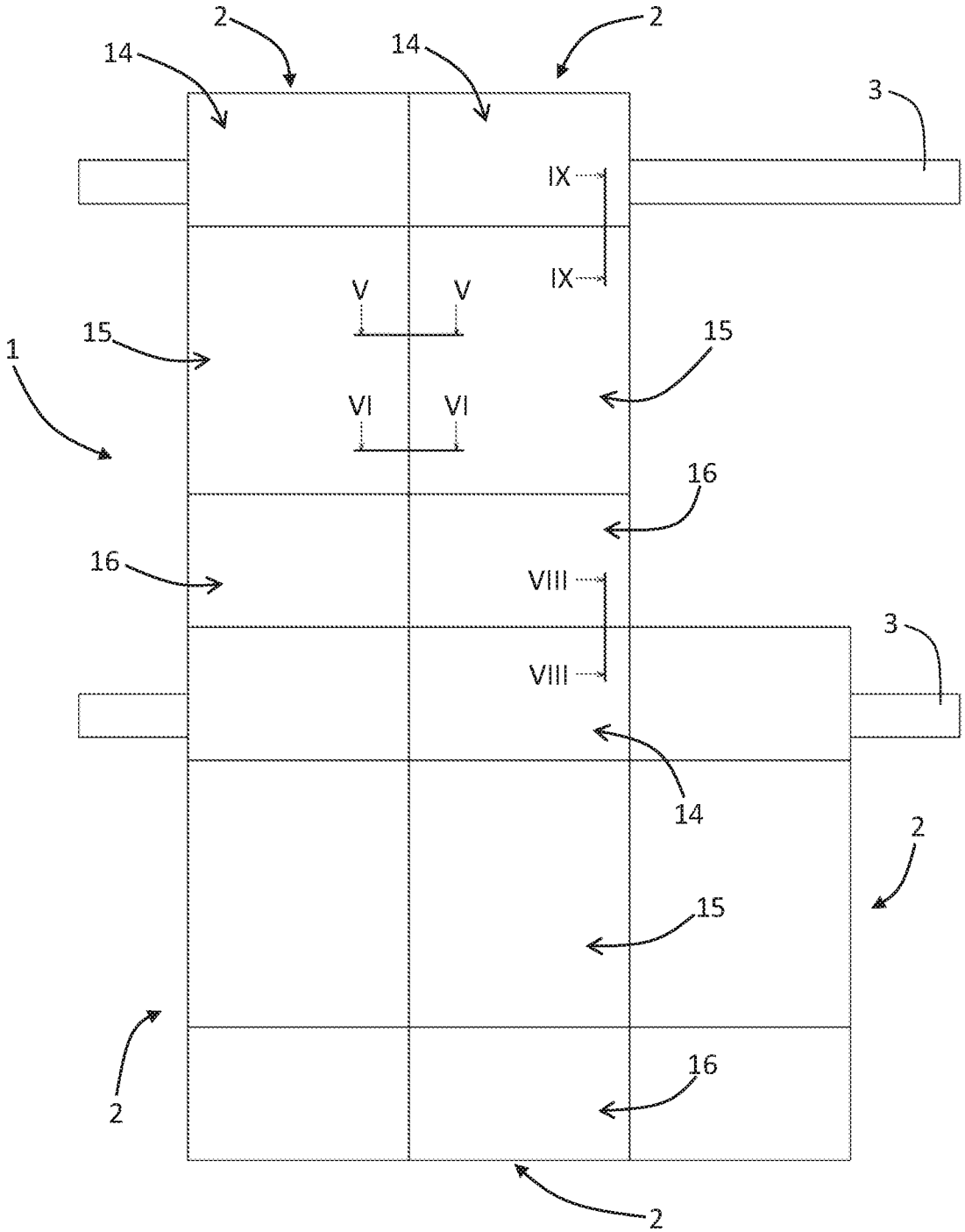
FIG. 2 is a schematic front elevation of a portion of a system provided according to possible embodiments of the invention.

Represented partially and schematically in FIGS. 1 and 2 is a closure system for building openings according to possible embodiments of the invention, here exemplified by a curtain wall, designated as a whole by 1.

Figure 10:
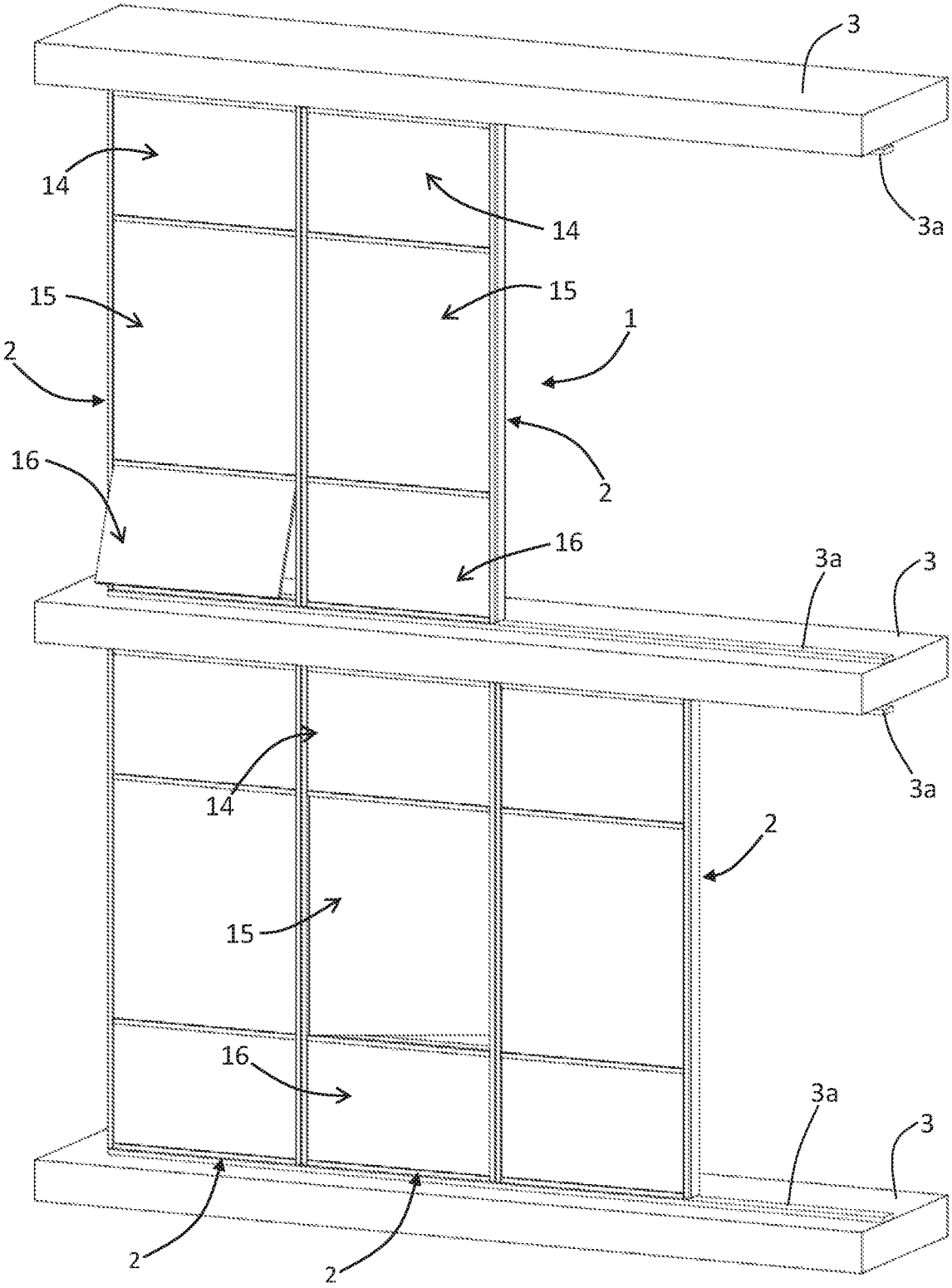
FIGS. 10 and 11 are a schematic perspective view and a schematic view in front elevation of a portion of a system provided according to further possible embodiments of the invention.
Figure 11:
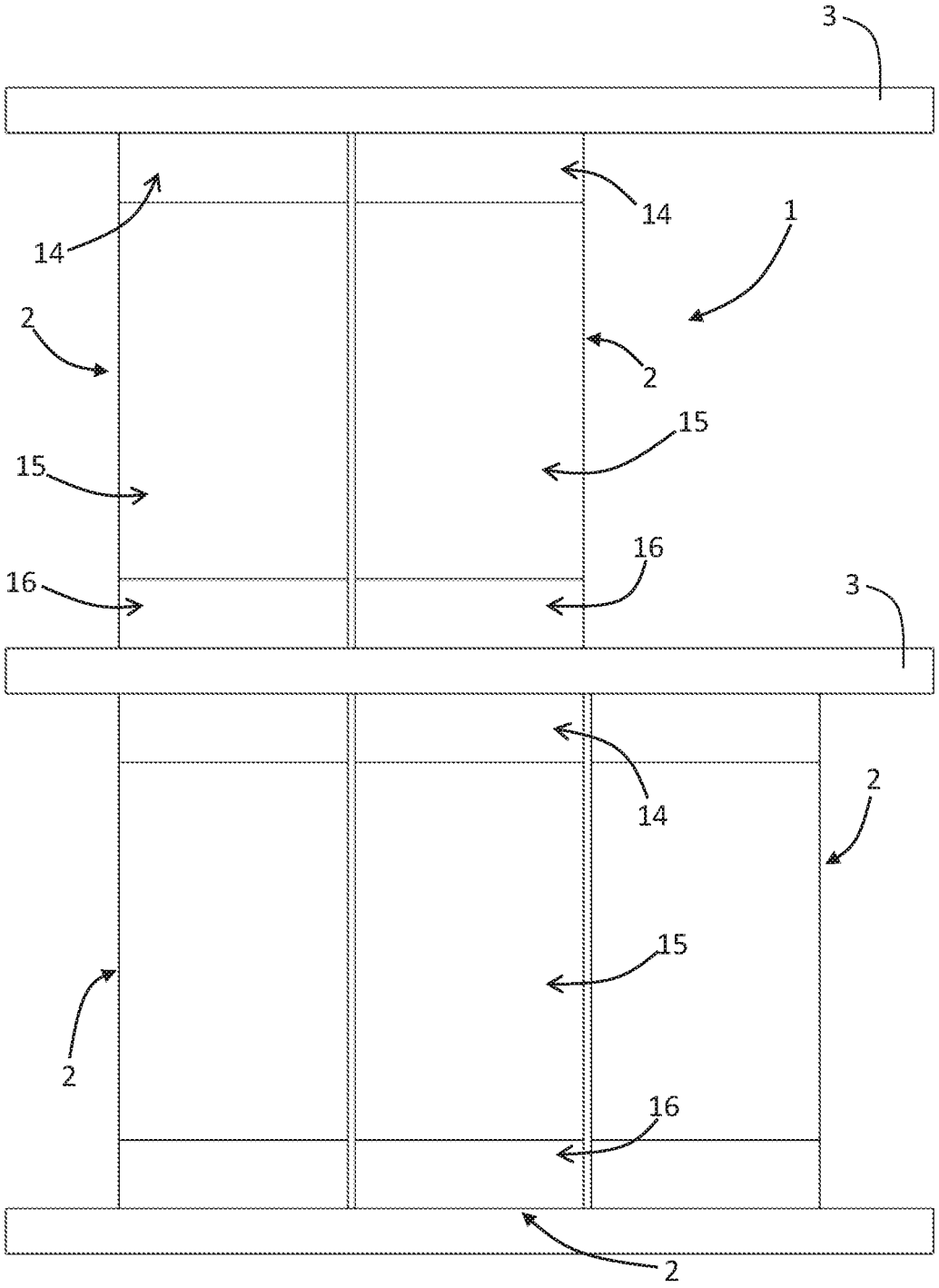

The curtain wall 1 comprises a plurality of prefabricated cells 2, which are supported by the load-bearing structure of a building, here represented by respective floors 3, for example made of reinforced concrete. The cells 2 have a substantially quadrangular conformation, preferably rectangular as in the example illustrated, but this shape must not be understood as imperative. The prefabricated cells 2 are preferably provided for being associated to the floors 3 of the building in positions set alongside or adjacent to one another both in the horizontal direction and in the vertical direction. Not, however, excluded from the scope of the invention are solutions in which the cells are set alongside in just one direction, as exemplified hereinafter with reference to FIGS. 10-11.

Figure 3:
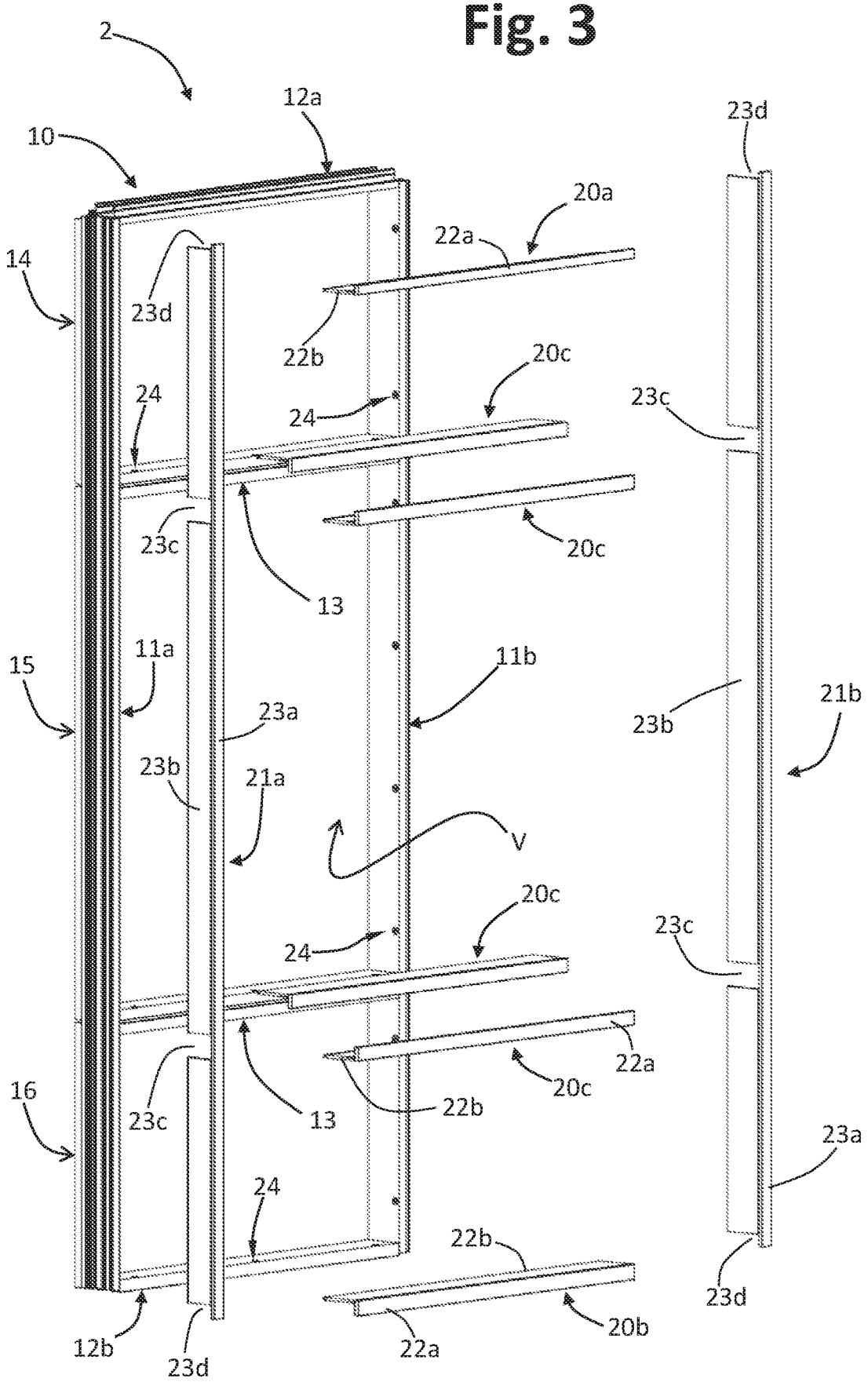
FIG. 3 is a perspective view of a structural frame forming part of a system according to possible embodiments of the invention, with a corresponding covering represented partially exploded.

In FIG. 3 a single cell 2 is visible, with a corresponding covering represented in exploded view. Each cell 2 has a structural frame, designated as a whole by 10, which comprises at least two lateral uprights, designated by 11*a* and 11*b*, and two end cross members, designated by 12*a* and 12*b*, the uprights being coupled in a way in itself known to the cross members so as to form a perimetral structure that delimits a space V. In the example, the structural frame 10 also comprises two intermediate cross members, designated by 13 (likewise the frame could comprise intermediate uprights).

The cell 2 further comprises one or more external infill elements, associated to the structural frame 10 at the front of the latter, for closing the space V. In the example, the cell 2 comprises three infill elements, of different sizes, designated by 14, 15, and 16. The elements 14 and 16 at the two ends of the cell have dimensions smaller than those of the element 15, being designed to close the portions of the space V that extend between the end cross member 12*a* and the upper intermediate cross member 13, and between the end cross member 12*b* and the lower intermediate cross member 13, respectively. The infill element 15 is, instead, designed to close the central portion of the space V, comprised between the two intermediate cross members 13. Obviously, configurations are possible with a different number of infill elements, starting from one.

The infill elements 14-16 may be fixed elements or else openable and closeable elements, such as doors or windows. In the example of FIGS. 1 and 2, some of the elements 15 and 16 are configured as openable and closeable windows. The infill elements 14-16 may comprise transparent or else opaque elements, according to the needs. In the sequel of the present description it is to be assumed that the elements 14-16 are as a whole transparent and each comprises at least two substantially parallel panes of glass, designated by 14', 15', and 16' in the ensuing figures.

In various embodiments, the cell 2 may also comprise at least one internal infill element, for example in the portion thereof close to a floor 3 of the building; such an internal infill element may, for example, be constituted by an opaque panel that closes the space V on the inner side of the cell 2, in a position corresponding to a respective external infill element 14.

In various embodiments, the upright 11*a* of a first frame 10 is configured for coupling with the upright 11*b* of a second frame 10 that is laterally adjacent to the first frame 10 in order to enable composition in a horizontal direction of the curtain wall. For this purpose, as will be seen, in various embodiments, the uprights 11*a* and 11*b* may be different from one another, with the outer side of one upright (i.e., the side facing towards the outside of the space V) that has a profile different from the profile of the outer side of the other upright.

Likewise, in various embodiments, the lower end cross member 12*b* of a first frame 10 is configured for coupling with the upper end cross member 12*a* of a second frame 10 that is adjacent at the top to the first frame 10, in order to enable composition of the curtain wall in a vertical direction. For this purpose, as will be seen, in various embodiments, the end cross members 12*a* and 12*b* may be different from one another, and in particular the outer side of the cross member 12*a* has a profile different from the profile of the outer side of the cross member 12*b*.

In various preferential embodiments, the main elements of the structural frame 10, i.e., the lateral uprights 11*a*, 11*b* and the end cross members 12*a*, 12*b*, as well as the possible intermediate cross members 13, comprise sectional elements made of metal material or metal alloy, preferably aluminum or aluminum-based alloys or other materials that are weakly attracted, or are not attracted, by a magnet. Not, however, excluded from the scope of the invention is the use of other materials.

FIG. 3 also shows in partially exploded view some components of a covering, designed to cover the frame 10 partially. In the case exemplified, the aforesaid covering includes a series of elements that are designed to cover substantially the part of the structural frame 10 that is designed to face towards the inside of the building, i.e., the corresponding part of the uprights 11*a*, 11*b*, of the cross members 12*a*, 12*b*, and of the possible cross members 13. In the sequel of the present description and in the attached claims, the part of the frame 10 or of its components that are to face towards the inside of the building will be conventionally defined as "back" or "inner side", the corresponding "front" or "outer side" being instead the part provided with the infill elements 14, 15, and 16, which is designed to face towards the outside of the building.

In various embodiments, the aforesaid covering includes two horizontal covering elements 20*a* and 20*b*, designed to cover the inner side of the cross members 12*a* and 12*b*, as well as two vertical covering elements 21*a* and 21*b*, designed to cover the inner side of the uprights 11*a* and 11*b*. In the example illustrated in FIG. 3, moreover provided are pairs of horizontal covering elements 20*c*, for covering substantially the inner side of the cross members 13. The covering elements 20*a*, 20*b* and 20*c* may advantageously have the same shape. On the other hand, as will be seen, the pairs of covering elements 20*c* may be replaced by a single covering element having a substantially U-shaped cross section.

In the non-limiting example illustrated, the covering elements 20*a* and 20*b* have a substantially L-shaped cross section so as to cover two substantially orthogonal sides of the cross members 12*a* and 12*b*, in particular their rear side, i.e., the side facing towards the inside of the building, and their lower side (cross member 12*a*) or upper side (cross member 12*b*), which delimits part of the space V. For this purpose, in various embodiments, the elements 20*a* and 20*b* comprise two parts or walls 22*a* and 22*b* designed to cover the aforesaid substantially orthogonal sides of the cross members. The elements 20*c* may have a similar conformation in order to cover substantially the inner side of the three orthogonal sides of the cross members 13 (front, upper, and rear sides).

Once again with reference to the example shown, also the vertical covering elements 21*a* and 21*b* have a substantially L-shaped cross section in order to cover two substantially orthogonal sides of the uprights 11*a* and 11*b*, i.e., their rear side and their side that delimits part of the space V. For this purpose, in various embodiments, also the elements 21*a* and 21*b*, preferably having the same shape, comprise two parts or walls 23*a* and 23*b* designed to cover the aforesaid two substantially orthogonal sides of the uprights. The wall 23*b* of the covering elements 21*a* and 21*b* may present intermediate interruptions 23*c* in the areas corresponding to the possible intermediate cross members 13, and recesses 23*d* which are set in with respect to the longitudinal ends of the corresponding wall 23*a*, in areas corresponding to the end cross members 12*a*, 12*b*.

It will in any case be appreciated that the construction and/or specific conformation of the horizontal covering elements 20*a*, 20*b* and 20*c* and of the vertical covering elements 21*a* and 21*b* may differ from the one exemplified, albeit guaranteeing mounting thereof on the structural frame 10 in order to cover its parts that are designed to face towards the inside of the building.

In various preferential embodiments, the covering elements 20*a*, 20*b*, 20*c*, 21*a* and 21*b* are made of wood, for example laminated wood or veneered multilayer wood, but not excluded is the use of other materials, for example plastic materials, metal materials, or stone materials (such as stone, marble, grès porcelain stoneware, etc.), the present list being intended as merely indicative of the materials that may be used.

According to one aspect of the invention, the covering elements of the structural frame, here exemplified by the elements 20*a*, 20*b*, 20*c*, 21*a*, and 21*b*, are constrained in at least one first region of the uprights and/or of the cross members of the structural frame via a magnetic-coupling arrangement.

In various embodiments, the covering elements are moreover constrained in at least one second region of the uprights and/or of the cross members of the structural frame, which is generally opposite or set apart from the one where the aforesaid magnetic-coupling arrangement is designed to operate: for this purpose a further magnetic-coupling arrangement and/or mechanical-coupling arrangement may be used.

In various embodiments, associated to at least one element of the structural frame is at least one magnet, whereas a corresponding element of the covering comprises or has associated thereto at least one element made of a material such as to be attracted by the at least one magnet, for example, comprising a ferromagnetic material. In the sequel of the present description and in the attached claims, for simplicity, such an element—which could itself be a magnet—will also be referred to as "ferromagnetic element". In various embodiments, a plurality of elements of the frame—such as the uprights 11*a*, 11*b*, the cross members 12*a*, 12*b*, and the possible cross members 13, have associated a plurality of magnets, which are able to attract one or more ferromagnetic elements associated to corresponding covering elements—such as the elements 20*a*, 20*b*, 21*a*, 21*b*, and possibly 20*c*. Of course, also possible is a reversed arrangement, i.e., with one or more magnets associated to a covering element and one or more ferromagnetic elements defined by, or associated to, a corresponding element of the structural frame.

Figure 4:
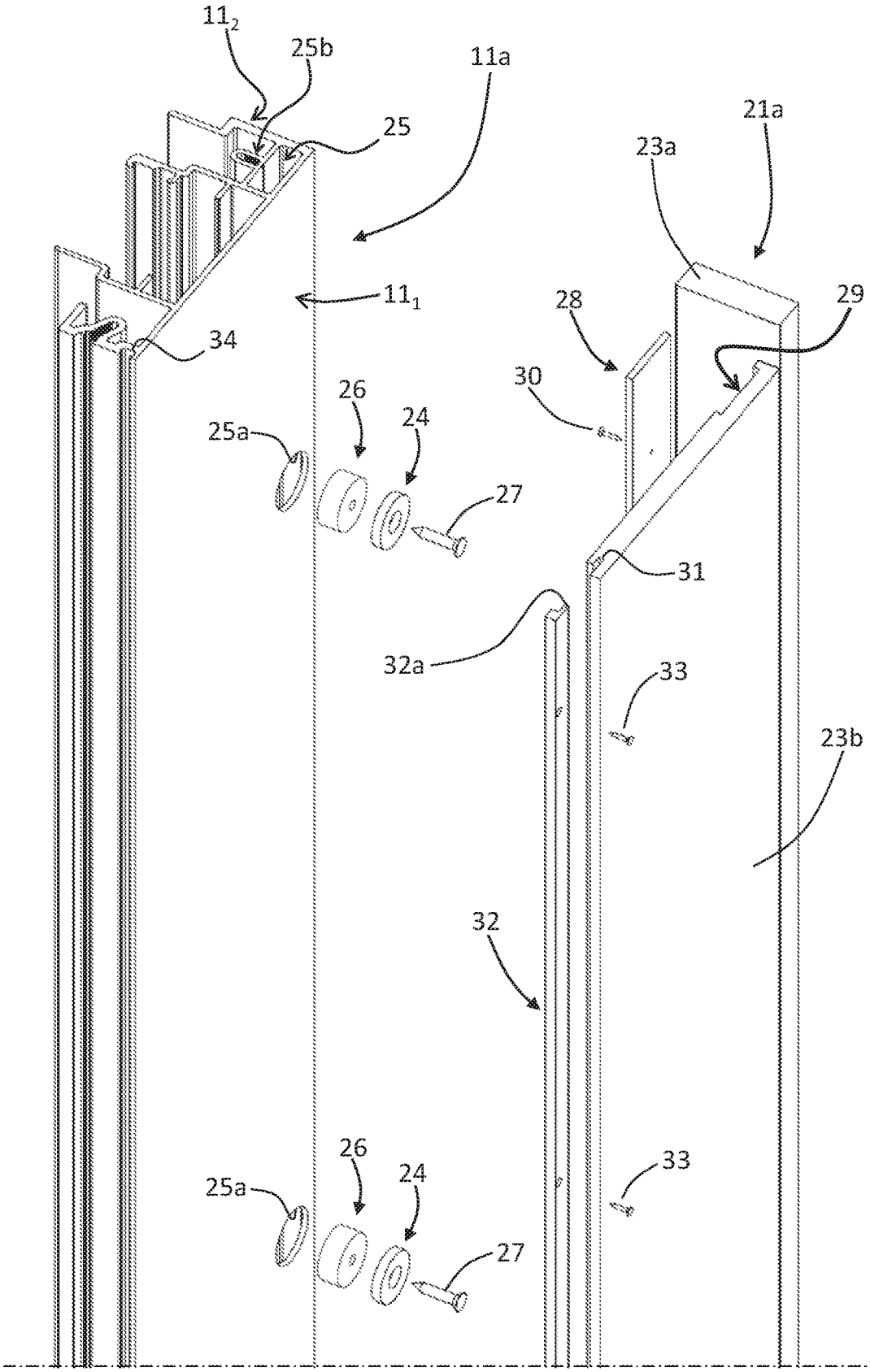
FIG. 4 is a partial and schematic perspective view of a part of a structural frame forming part of a system according to possible embodiments of the invention, with a corresponding covering element represented partially exploded.

For a better understanding of this aspect, FIG. 4 is a schematic representation of an upper end portion of the upright 11*a* and of a corresponding covering element 21*a*, according to possible embodiments. From this figure it may be noted how the element 21*a* is provided in two substantially orthogonal parts or walls 23*a* and 23*b*, designed to cover the corresponding sides $\mathbf{11}_1$ and $\mathbf{11}_2$ of the upright 11*a*, i.e., its side facing towards the inside of the building and its side delimiting part of the space V of FIG. 3.

In the example, associated to the upright 11*a* are a plurality of permanent magnets, for example having an annular shape, two of which are designated by 24. For this purpose, in various embodiments, the sectional element that provides the upright 11*a* is shaped so as to define a longitudinal seat 25, delimited at the front by one of the outer sides of the upright, for example, its longer side $\mathbf{11}_1$. Defined in this side $\mathbf{11}_1$, in the seat 25, are a series of through openings, two of which are designated by 25*a*, designed to receive a corresponding magnet 24.

In various embodiments, for mounting purposes, each magnet is superimposed to a corresponding spacer element, preferably made of plastic material. In the case exemplified, each magnet 24 is mounted on a disk-shaped spacer 26, designed to rest on the bottom of the seat 25. In the non-limiting example illustrated, the magnets 24, the openings 25*a*, and the spacers 26 have a circular shape, but this shape is not imperative.

The unit formed by each magnet 24 and the corresponding spacer 26 is mounted through the corresponding opening 25*a* and fixed inside the seat 25, for example via threaded means, such as a screw 27, preferably of a self-tapping type. For this purpose, the bottom wall of the seat 25 may be shaped to define a longitudinal housing 25*b* for the threaded part of each screw 27, although this is not indispensable (it being possible for the bottom of the seat 25 to envisage simple holes for the screws 27). Preferably, the heads of the screws 27 are of a flared type, or in any case of a shape and/or dimensions such that they can be received in a corresponding shaped central hole of the magnets 24. In this way, as visible for example in FIG. 5, in the assembled condition, the front surface of the magnets 24 is substantially flush with the surface of the wall $\mathbf{11}_1$ of the upright 11*a*, without the heads of the screws 27 projecting beyond this surface.

On the other side, the element 21*a* has at least one ferromagnetic element, which, in the assembled condition of the covering, faces at least one magnet 24. In various embodiments, associated to the element 21*a* is a ferromagnetic element designed to face a plurality of magnets 24. Such a case is exemplified in FIG. 4, where designated by 28 is a longitudinally extending ferromagnetic element, for example in the form of a strip or strap of steel (not stainless steel), which extends in the direction of length of the covering element 21*a*. As mentioned, the element 28 could be a magnet, of a polarity opposite to that of the magnet 24.

In various embodiments, the element 21*a* defines a corresponding seat 29 for the element 28, for example a surface groove, defined in the part of the element 21*a* designed to face the side $\mathbf{11}_1$ of the upright 11*a*. Hence, in the example, this seat 29 is defined on the inner surface of the wall 23*b* of the covering element 21*a*. The ferromagnetic element 28 may be fixed inside the corresponding seat 29, for example with screws 30 or similar threaded means.

In the case where the covering element 21*a* is of the type shown in FIG. 3, there may be provided two or three longitudinal ferromagnetic elements 28 and corresponding seats 29, given the presence of the intermediate interruptions 23*c* of the wall 23*b*.

In various preferred embodiments, between a covering element and the sectional element that constitutes the corresponding upright or cross member there may be provided further coupling means, which are operative in a region of the element itself generally opposite or set apart with respect to the one where the magnetic-coupling means exemplified previously are designed to operate.

In various embodiments, the aforesaid further coupling means comprise a mechanical-coupling arrangement. With reference once again to the example of FIG. 4, defined in an end region of the wall 23*b* of the covering element 21*a* is a longitudinal seat 31, within which a corresponding portion 32*a* of an engagement member 32 is to be received. In various embodiments, the engagement member 32 has a length that is substantially equal to that of the corresponding covering element (obviously except for the possible interruptions 23*c* and recesses 23*d*, in the case of an element 21*a* or 21*b* of the type shown in FIG. 3). The engagement member 32 is designed to be fixed to the corresponding upright 11*a*, for example via self-tapping screws 33, in particular at a side thereof on which the magnets 24 are provided, here the side 11*a*. The engagement members 32, for example in the form of rods having a substantially L-shaped cross section, may be made of a metal material or a metal alloy.

Figure 5:
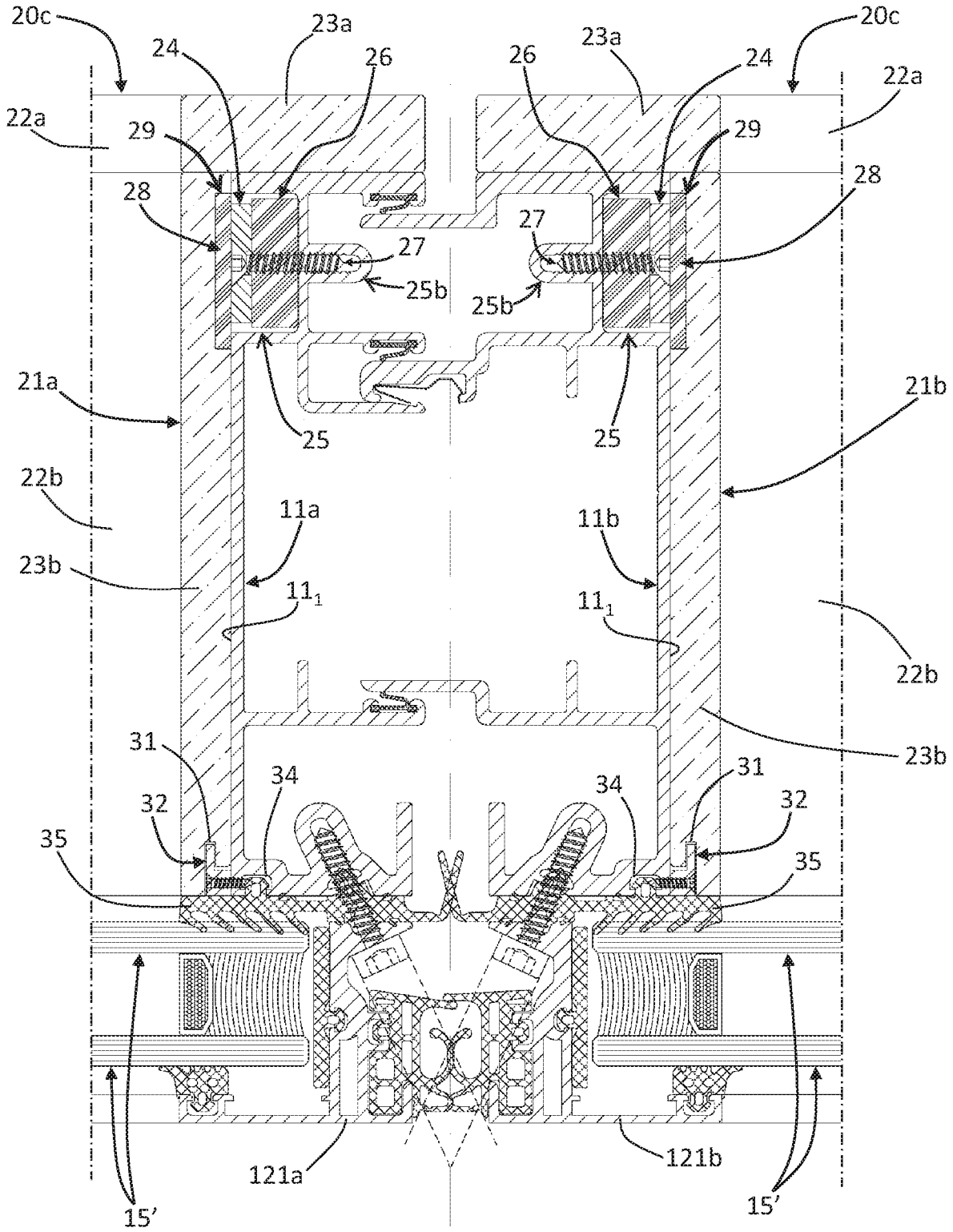
FIG. 5 is a schematic cross-sectional view according to line V-V of FIG. 2.
Figure 6:
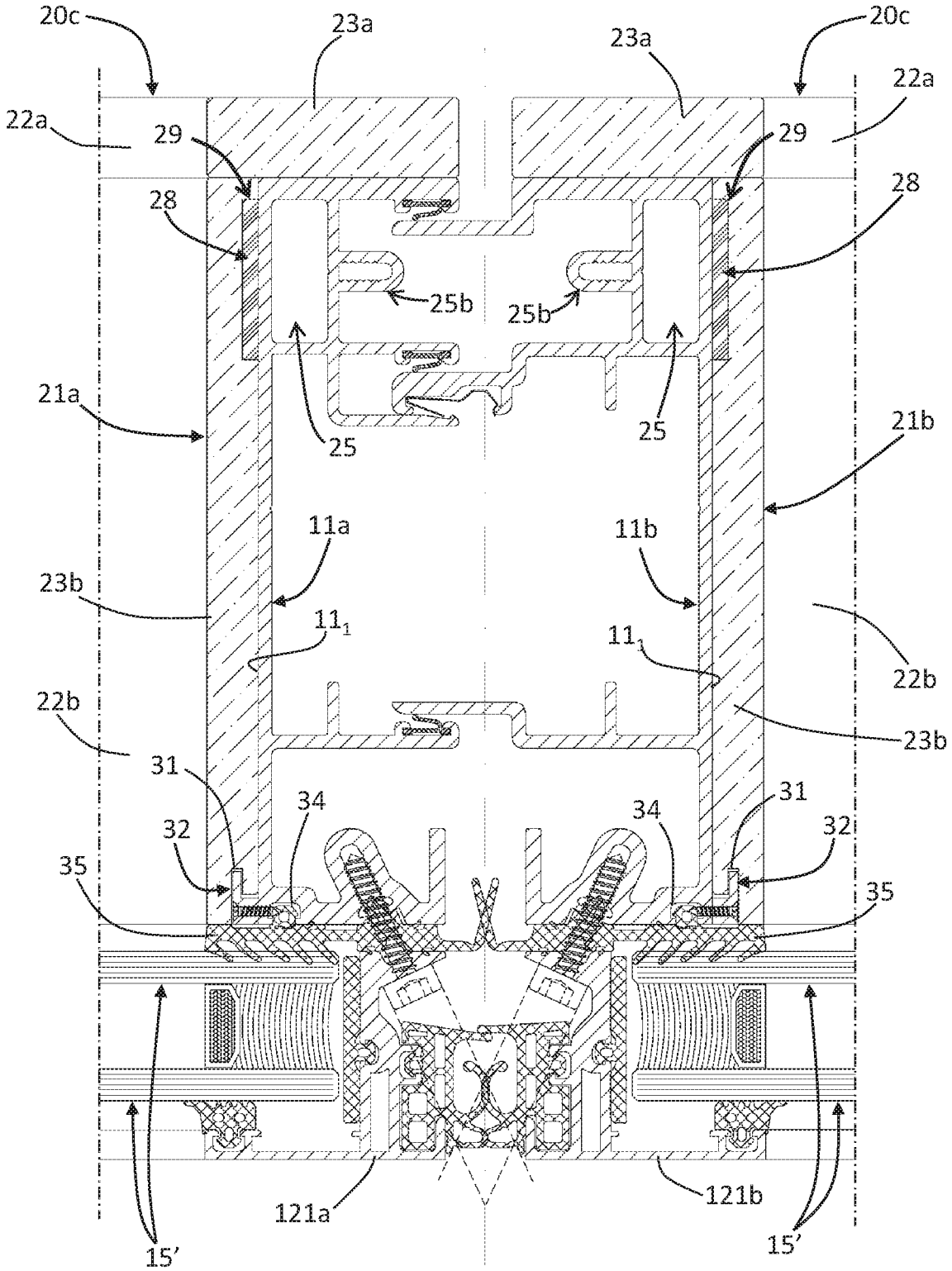
FIG. 6 is a schematic cross-sectional view according to line VI-VI of FIG. 2.
Figure 7:
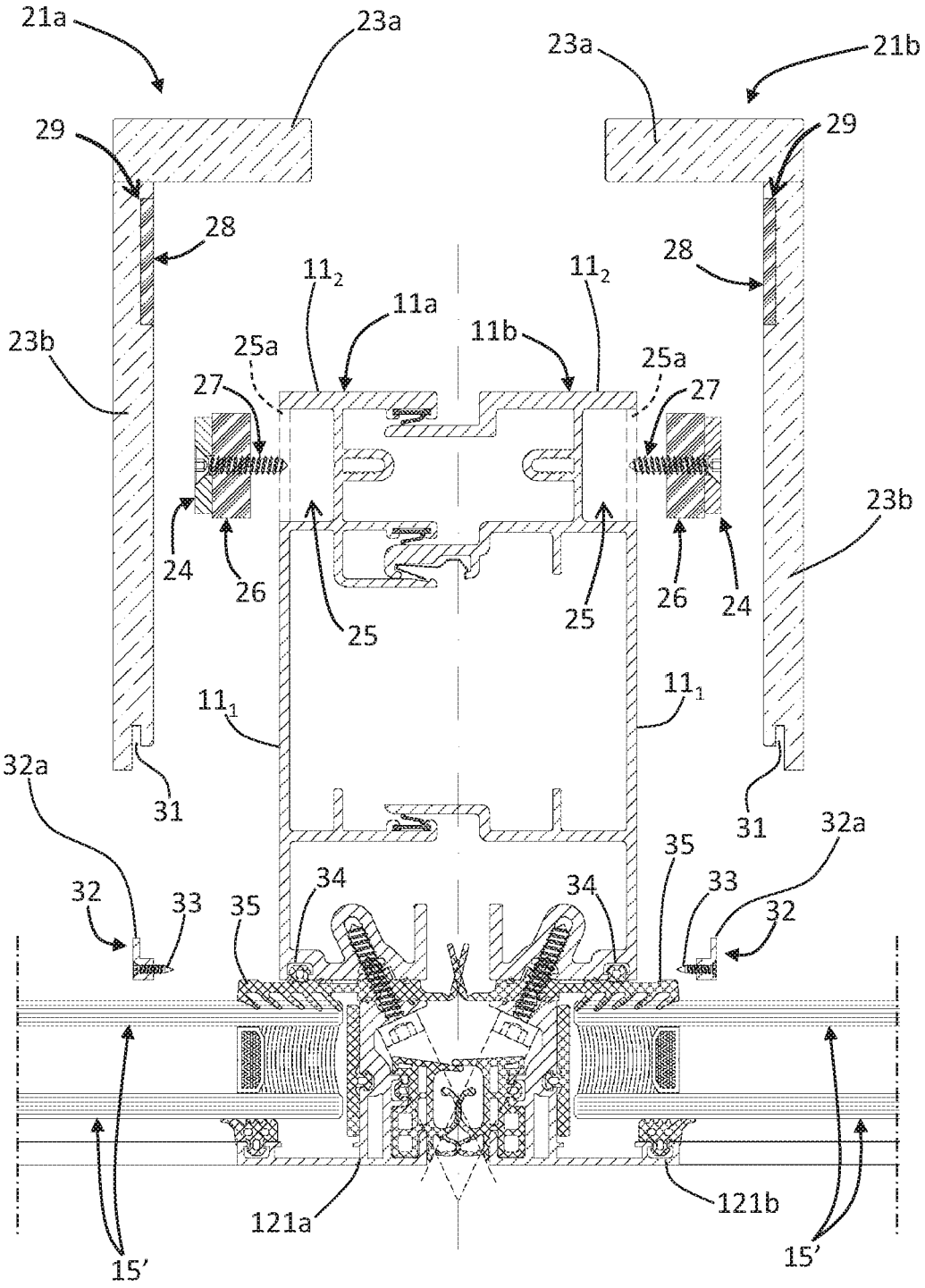
FIG. 7 is a partially exploded schematic representation of the cross section of FIG. 5.

FIGS. 5 and 6 illustrate two sections at different heights, in an area of union between two laterally adjacent cells 2 or frames 10, whereas FIG. 7 is an exploded partial view of the components visible in FIG. 5.

From FIGS. 5-7 it may be clearly noted how—in various embodiments—the two uprights 11*a* and 11*b* have a different shape, in particular in the respective interface side, i.e., the side pre-arranged for enabling lateral coupling between the uprights themselves. In the case exemplified, also visible are pairs of panes of glass 15' that constitute the infill elements 15 of the two frames 10 set laterally alongside one another (see FIGS. 1 and 2), these panes of glass 15' being here held in position via further metal sectional elements 121*a* and 121*b*, fixed at the front with screws to the uprights 11*a* and 11*b*. It should be noted that the modalities of lateral coupling of the uprights 11*a* and 11*b*, the modalities of coupling between the uprights and the cross members, and the modalities of fixing of the panes of glass 15' are regardless of the purposes of the invention, and may hence be of any known type (in this perspective, it is pointed out, for example, that the panes of glass could be of a structural type, i.e., glued via purposely provided structural glues directly to the uprights and to the cross members of a structural frame, or else to corresponding interface sectional elements fixed to the front of the aforesaid uprights and cross members).

From FIG. 5 there may be clearly noted the positioning of two magnets 24 within the corresponding longitudinal seats 25, with the corresponding spacers 26 resting on the bottom of the seats, and with part of the threads of the fixing screws 27 engaged in the corresponding longitudinal housings 25*b*. As may be seen, the positioning is such that the front surface of the magnets 24 is substantially flush with the outer surface of the corresponding sides $\mathbf{11}_1$ of the uprights 11*a* or 11*b*. From the same FIG. 5, as well as from FIGS. 6 and 7, it may moreover be noted how the ferromagnetic elements 28 are housed within the corresponding seats 29 defined in the corresponding covering element 21*a*, 21*b*, with their front surface substantially flush with the surface of the wall 23*b* where the seat 29 itself is defined.

Also visible in FIGS. 5 and 6 is a possible modality of fixing of the coupling members 32, which are secured via the screws 33 to the uprights 11*a*, 11*b* in a generally front part of the their sides $\mathbf{11}_1$. In various embodiments, such as the one represented, the tips of the screws 33 engage in seats 34 that open on the front of the uprights 11*a* or 11*b*, seats of this type being typically provided for mounting weatherstrips 35 designed to operate between the front of the uprights themselves and the innermost pane of glass 15'.

As may be appreciated in particular from FIG. 5, in the assembled condition, the covering elements 21*a* and 21*b* are constrained to the corresponding uprights 11*a* and 11*b* via the two different magnetic-coupling and mechanical-coupling arrangements. The magnets 24 and the ferromagnetic element 28 are preferably positioned in a rear corner region of the uprights 11*a*, 11*b* and of the corresponding covering element 21*a* or 21*b*, in order to ensure that in this region the walls 23*a* and 23*b* of the covering element are held in position. On the other side, engagement of the part 32*a* of the engagement members 32 (FIG. 7) with the corresponding seats 31 defined at the front edge of the walls 23*b* mechanically constrains in position the covering element 21*a* or 21*b* in a front corner region of the uprights 11*a*, 11*b*.

The various parts of the two magnetic-coupling and mechanical-coupling arrangements are clearly visible from the partial exploded view of FIG. 7.

The same principles set forth above in relation to mounting of the covering elements 21*a* and 21*b* of the uprights 11*a*, 11*b* may be exploited also for fixing the covering elements 20*a* and 20*b* to the corresponding end cross members 12*a* and 12*b* of the frame 10 of FIG. 3, as well as for fixing the covering elements 20*c* to the corresponding intermediate cross members 13, when envisaged.

Figure 8:
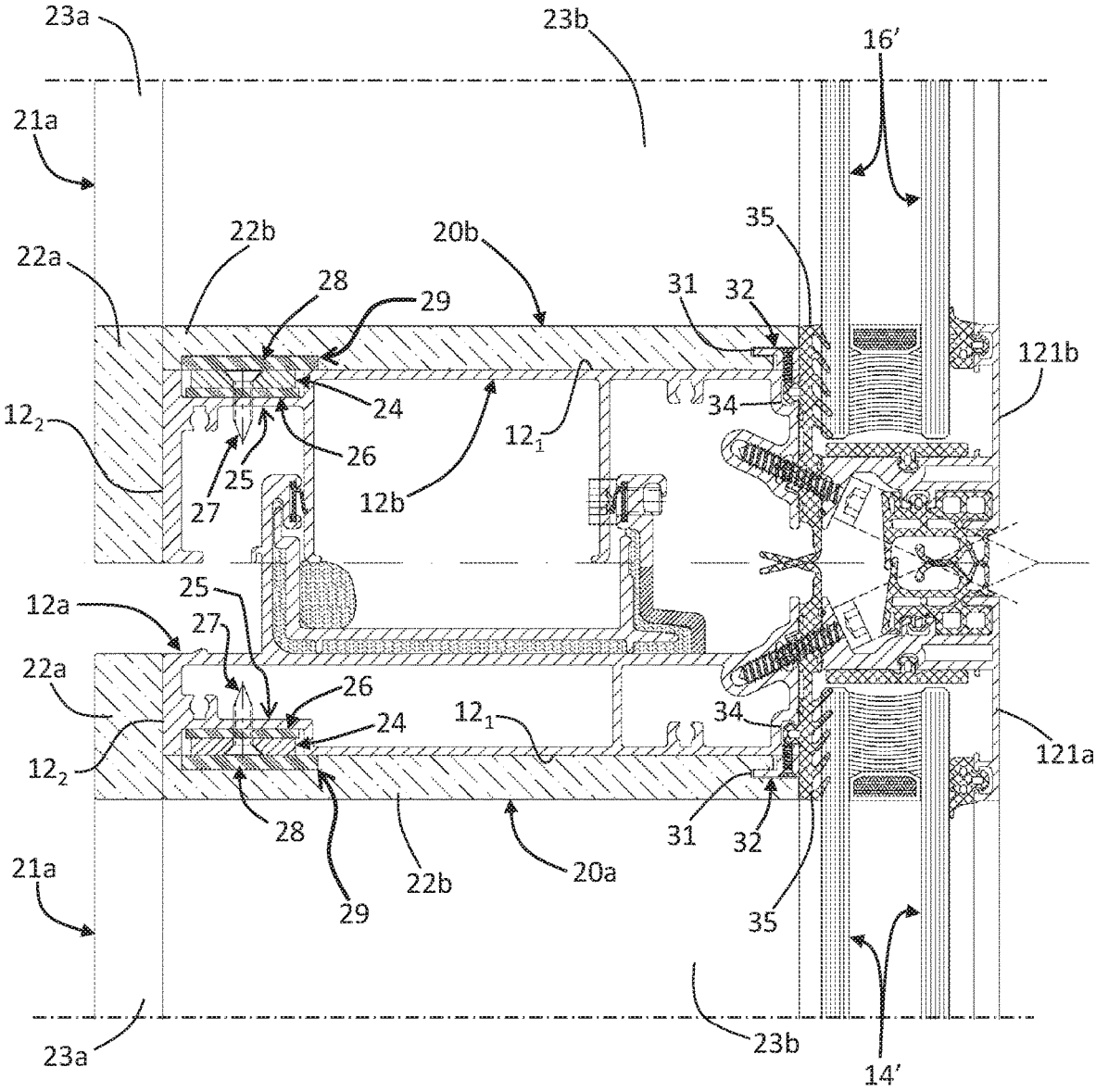
FIG. 8 is a schematic cross-sectional view according to line VIII-VIII of FIG. 2.

FIG. 8 illustrates, for example, the case of covering of two end cross members 12*a* and 12*b* coupled together in the vertical direction. From FIG. 8 it may be noted how—in various embodiments—the two end cross members 12*a* and 12*b* have a different shape, in particular on the respective interface side, i.e., the side pre-arranged for enabling vertical coupling between the cross members themselves. In the case exemplified, also visible are pairs of panes of glass 14' and 16' that constitute infill elements 14 and 16 for the two frames 10 vertically set on top of one another (see FIGS. 1-2). Also in this case, the panes of glass 14' and 16' are held in position via further metal sectional elements 121*a* and 121*b*, fixed at the front with screws to the cross members 12*a* and 12*b*. Also the modalities of coupling of the uprights 12*a* and 12*b* on one another, and the modalities of fixing of the panes of glass 14' and 16' are regardless of the purposes of the invention and may be provided in any known way, as mentioned above in relation to the uprights 11*a* and 11*b*.

From FIG. 8 it may be clearly noted how also the sectional elements that constitute the cross members 12*a* and 12*b* are provided with a corresponding longitudinal seat 25, housed in which are corresponding magnets 24, associated to corresponding spacers 26 that rest on the bottom of the seat 25. Of course, also in this case in the wall of the sectional element that delimits the front of the longitudinal seat (here the wall designated by $\mathbf{12}_1$ in FIG. 8) through openings are provided similar to those designated by 25*a* in FIG. 4. In the case represented, the bottom of the seat 25 does not have a specific housing (25*b*, FIGS. 4-6) for the screws 27, this housing being on the other hand altogether optional. The covering elements 20*a* and 20*b* are provided, in the respective walls 22*b*, with the seat 29 that houses the electromagnetic element 28 in a position facing the magnets 24. Once again from FIG. 8 it may be noted how, also in this case, the engagement members 32 are provided, designed for coupling with the seats 31 defined substantially at the front edge of the walls 22*b* of the covering elements 12*a* and 12*b*, these engagement members 32 being secured with screws to the respective cross member 12*a*, 12*b*, in a way similar to what has already been described previously.

As may be appreciated, the modalities of magnetic and mechanical fixing of the covering elements 20*a* and 20*b* to the cross members 12*a* and 12*b* is substantially technically similar to what has been described above with reference to FIGS. 4-7. It should be noted that in the example shown the walls 22*a* of the covering elements 20*a* and 20*b* have a height substantially equal to that of the walls designated by $\mathbf{12}_2$ of the sectional elements that constitute the cross members 12*a* and 12*b*, thereby leaving a small gap between their facing ends. However, in possible embodiments, the walls 22*a* of the covering elements 20*a* and 20*b* could have a different length, for example chosen in order to avoid the presence of the aforesaid gap.

Figure 9:
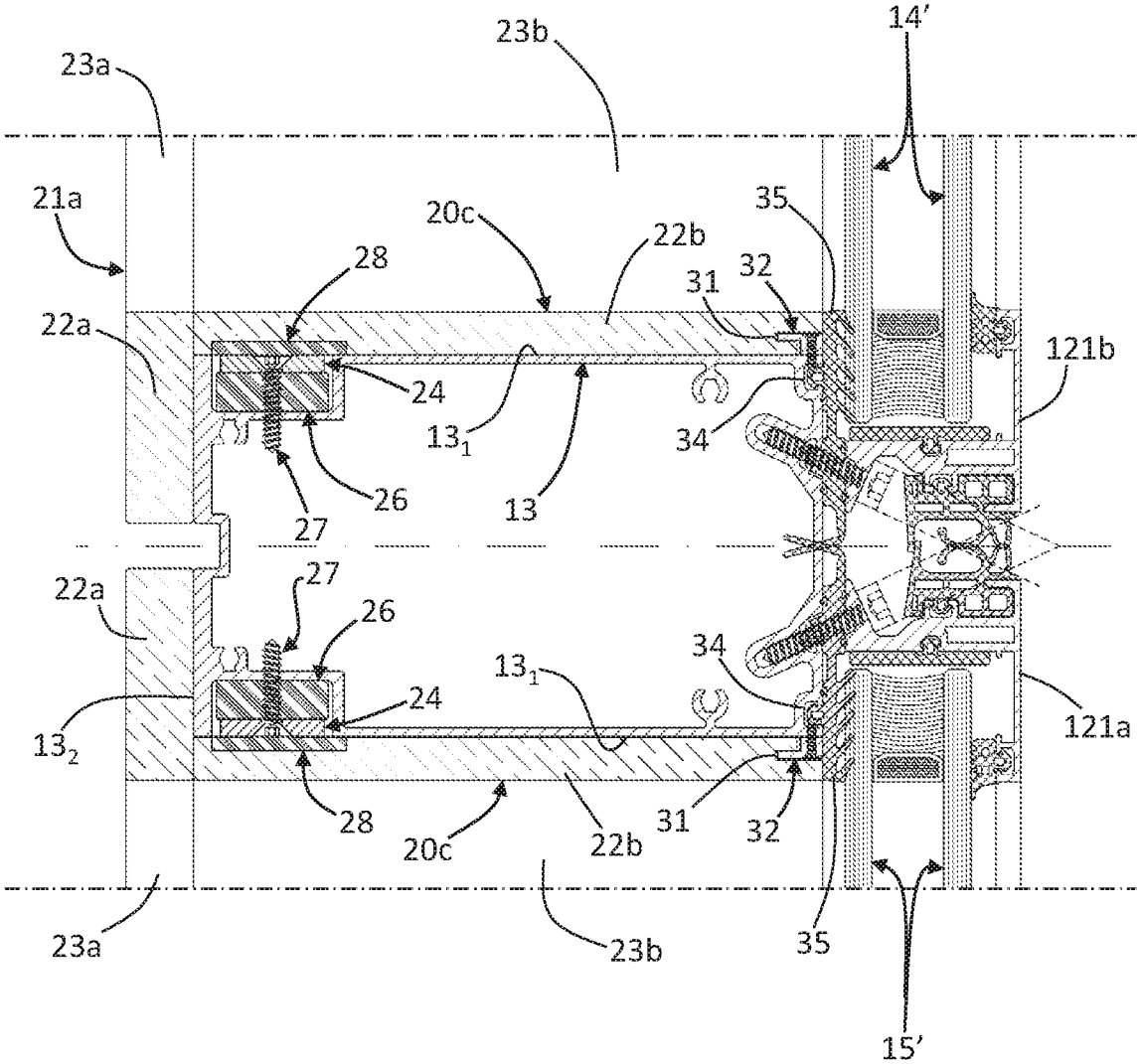
FIG. 9 is a schematic cross-sectional view according to line IX-IX of FIG. 2.

FIG. 9 illustrates the case of covering of an intermediate cross member 13, here constituted by a substantially quadrangular sectional element, associated to the front of which are pairs of panes of glass 14' and 15' that constitute infill elements 14 and 15 of the frame 10 in question (see FIGS. 1-2). Also in this case, the panes of glass 14' and 15' are held in position via further metal sectional elements 121*a* and 121*b*, fixed at the front with screws to the cross member 13. The modalities of fixing of the panes of glass 14' and 15' are regardless of the purposes of the invention and may be provided in any known way, as already mentioned above, also by means of structural glues.

From FIG. 9 it may be clearly noted how the sectional element that constitutes the intermediate cross member 13 is provided with two corresponding longitudinal seats 25, in particular in its two rear corner regions, housed in which are the magnets 24 associated to the corresponding spacers 26, which rest on the bottom of the corresponding seats 25. Also in this case, in the opposite walls of the sectional elements that delimit the front of the two longitudinal seats 25 (here the two walls designated by $\mathbf{13}_1$) through openings are provided similar to those designated by 25*a* in FIG. 4. Also in the case represented, the bottom of the seat 25 does not have a specific housing (25*b*, FIGS. 4-6) for the screws 27. The covering elements 20*c* are provided, in the respective walls 22*b*, with the seat 29 that houses the ferromagnetic element 28 in a position facing the magnets 24. Also in this case, the engagement members 32 are provided, designed for coupling with the seats 31 defined substantially at the front edge of the walls 22*b* of the covering elements 20*c*, these engagement members 32 being secured with screws to the cross member 13, as already described previously.

Also the modality of magnetic and mechanical fixing of the covering elements 20*c* to the cross member 13 is substantially similar from a technical standpoint to what has been described previously with reference to the uprights 11*a*, 11*b* and to the end cross members 12*a*, 12*b*. In the example shown, the walls 22*a* of the covering elements 20*c* have as a whole a height smaller than that of the rear wall (designated by $\mathbf{13}_2$) of the sectional element that constitutes the cross member 13, hence leaving a small gap between the facing ends of the walls 22*a*: however, in possible embodiments, the walls 22*a* of the covering elements 20*c* could have a length such as to avoid the presence of the aforesaid gap. Moreover, as will be seen, two distinct covering elements 20*c* could be replaced by a single covering element with a substantially U-shaped cross section.

Previously, the invention has been exemplified in relation to construction of a curtain wall, with an arrangement of a number of cells or structural frames in a position laterally set alongside and vertically set on top of one another. The invention may, however, be applied also to the case of curtain walls having cells set alongside one another only in the horizontal direction or else only in the vertical direction. For example, FIGS. 10 and 11 exemplify construction of a number of walls obtained from the side-by-side arrangement of a number of cells 2, in a position set in with respect to the front edge of the floors 3 of a building. In these implementations, the upper and lower ends of the cells (i.e., the end cross members 12*a* and 12*b* of the corresponding structural frames) are coupled to respective mounting elements 3*a*—for example, comprising metal sectional elements—which are previously secured to the upper and lower sides of each floor 3, the foregoing according to a technique in itself known. It will in any case be appreciated that, also in implementations of the type illustrated schematically in FIGS. 10 and 11, the modality of magnetic and mechanical coupling of the covering for the inner side of the structural frames may be similar to the one described previously.

In the embodiments exemplified previously, the coupling arrangement used for mechanically constraining the various covering elements 20*a*, 20*b*, 20*c*, 21*b*, 21*b* to the metal sectional elements that constitute the respective cross members and uprights comprises longitudinal engagement members 32, which extend substantially for the entire length, or for most of the length, of the covering elements themselves. In possible variant embodiments, however, the elements of the covering may be constrained only locally to the respective sectional elements, even without any need for screws, for example via local-hooking members, such as elastic clips or the like.

Figure 12:
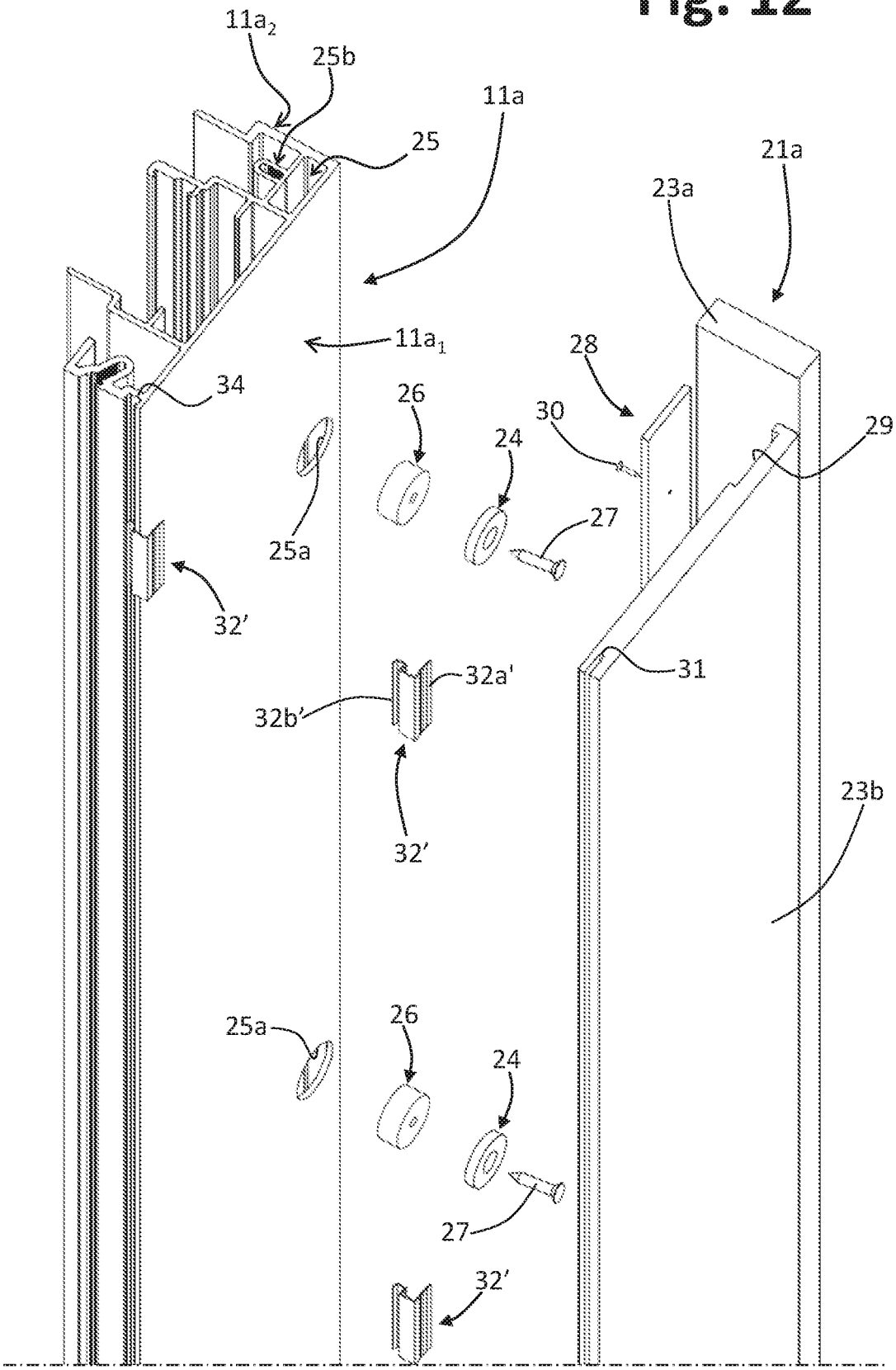
FIG. 12 is a partial and schematic perspective view of a part of a structural frame forming part of a system according to further possible embodiments of the invention, with a corresponding covering element represented partially exploded.

A possible embodiment of this type is exemplified in FIG. 12, in relation to an upright 11*a* and to a corresponding covering element 21*a*. In the case represented, instead of a longitudinally extending engagement member 32, a plurality of hooking members in the form of metal clips 32' are used. In various embodiments, these clips 32' are substantially L-shaped, with a first portion 32*a*' designed to engage in a corresponding seat 31, substantially of the type already described previously, and a second portion 32*b*' that is shaped for direct engagement in the front seat 34 of the upright 11*a* that is provided for mounting the weatherstrip 35 designed to co-operate with the inner side of an infill element.

Figure 13:
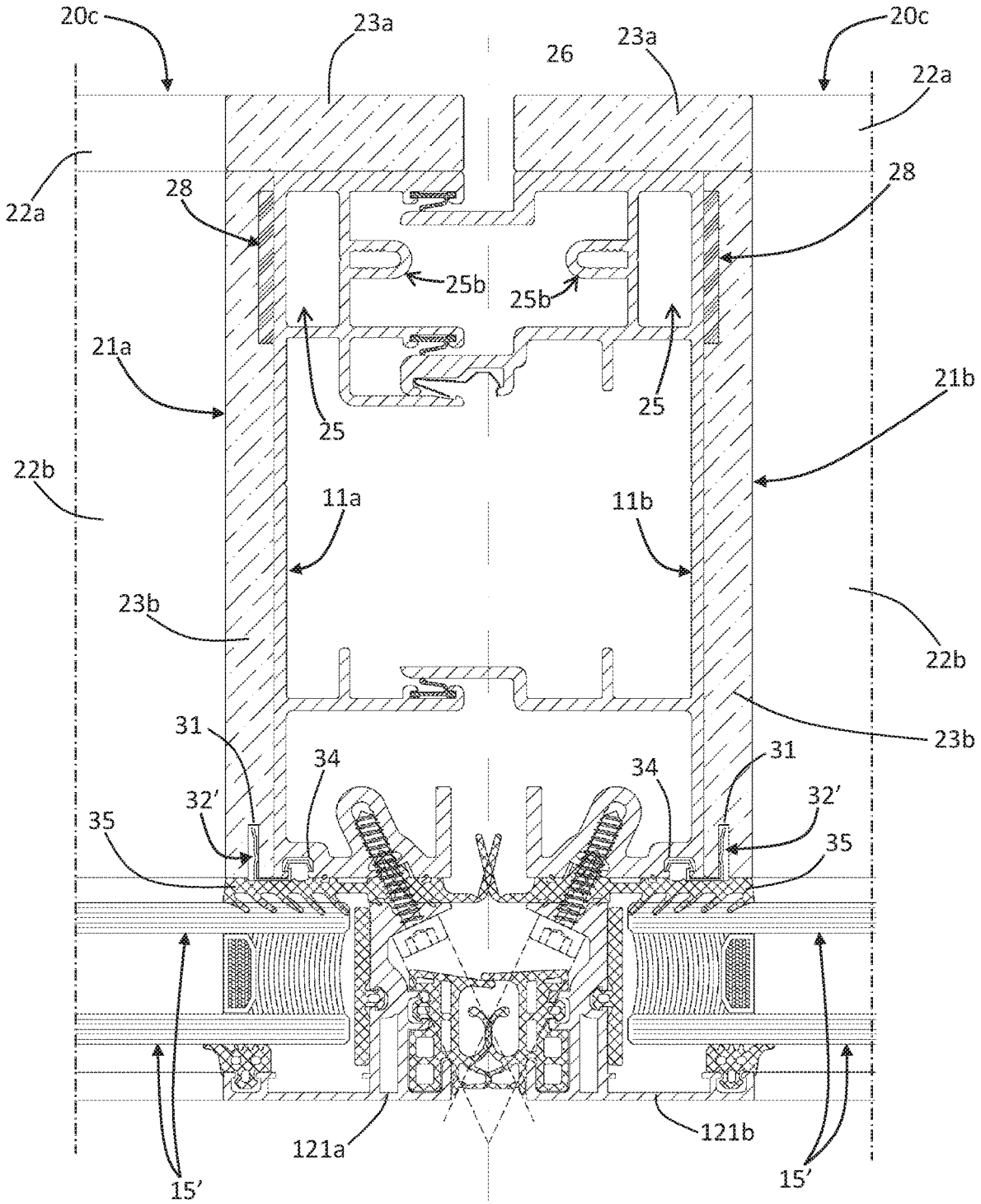
FIG. 13 is a schematic cross-sectional view, similar to that of FIG. 5, corresponding to an embodiment of the type illustrated in FIG. 12.
Figure 14:
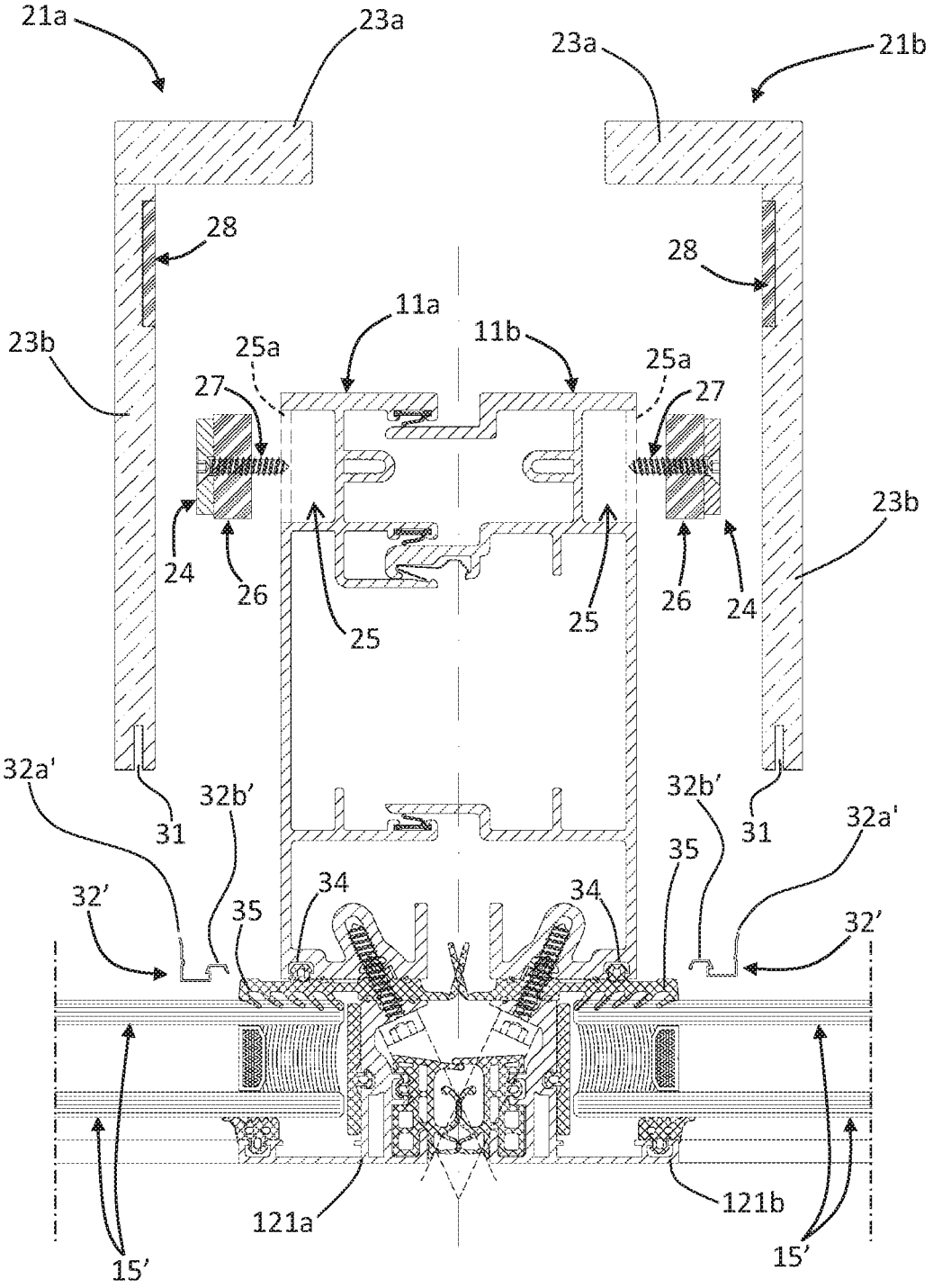
FIG. 14 is a partially exploded schematic representation of the cross section of FIG. 13.

The concept is highlighted in the subsequent FIGS. 13 and 14. The clips 32' are mounted with their portion 32*b*' within the seats 34. As may be noted, in various embodiments, the portion 32*b*' of the clips 32' is shaped so as to reproduce at least in part the shape of the seats 34. Mounted then within the seats 34, and hence of the portions 32*b*' of the clips 32', is the corresponding anchorage part of the weatherstrips 35 (in the case exemplified in FIG. 13, this anchorage part has not been represented for requirements of clarity; on the other hand, also in possible practical implementations, this anchorage part may be locally removed, for example cut, in order to enable easier mounting of the weatherstrip 35 in the area where the clips 32' are present, or else easier mounting of the clips 32' after the weatherstrip 35 has already been mounted in place on the structural frame).

Hence, as may be appreciated, the clips 32' can be engaged locally on the sectional elements that constitute the upright 11*a*, without any need to provide holes and/or gripping screws. It should be noted that the metal sectional elements used for providing structural frames of the type considered herein typically present a seat for a weatherstrip designed to operate between the front of the sectional element itself and a pane of glass or other front infill element so that the use of hooking member 32' of the type referred to is particularly advantageous in such cases.

Preferentially, the clips 32' are mounted on the parts of the structural frame prior to mounting of the weatherstrips 35 and of the corresponding infill elements, but mounting thereof subsequently is not excluded.

Of course, what has been explained in relation to the uprights 11*a* and 11*b* of FIGS. 12-14 is applicable also to the case of the end cross members 12*a*, 12*b* and of the possible intermediate cross members 13 of the structural frame 10.

As mentioned previously, one or more of the infill elements that equip a cell or a structural frame may be openable like a window. In these cases, the openable infill element is coupled to the corresponding uprights 11*a*, 11*b* and/or to the corresponding cross members 12*a*, 12*b* and/or 13 in a movable way, via suitable interface sectional elements, according to a technique in itself known. It will be appreciated that in these cases the covering elements described previously may be shaped accordingly in order to enable mounting of the aforesaid interface sectional elements and to prevent interference with the movements of the infill elements, according to modalities that will appear evident to the person skilled in the art.

Obviously, the shape of the sectional elements used for providing the uprights and the cross members of the structural frames according to the invention may be different from what has been exemplified previously, without prejudice to the preferential prearrangement of the seats 25 and of the corresponding front openings 25*a*. Likewise, the covering elements may have a shape different from the one exemplified previously, without prejudice to the preferential prearrangement of the seats for the corresponding ferromagnetic elements 28.

Previously, reference has been made to elements of a structural frame (such as the uprights 11*a*, 11*b* and the cross members 12*a*, 12*b* and 13) that are prearranged in the production stage for the purpose of defining the seats and the holes designed to enable mounting of the magnets provided according to the invention (for example, via suitable prearrangement of the equipment with which the aluminum sectional elements designed to form the structural frames are extruded).

According to a different aspect of the invention, it is, however, possible to envisage a covering kit that can be used also in combination with commercial sectional elements and/or sectional elements produced by customizer, of a standard type or else purposely designed.

Illustrated, for example, in FIGS. 15 and 16, is part of a covering kit provided for this purpose, comprising a magnetic assembly designated as a whole by 40 (in addition to at least one corresponding coupling member, for example of the type designated previously by 32 or 32'). The assembly 40 comprises a supporting element 41, which includes a platelike part 41*a*, defining—preferably in a central position—a housing or seat 41*b* open at the front, in order to receive a corresponding permanent magnet 24', here substantially shaped like a bushing. The platelike part 41*a* preferentially has holes 41*c* for corresponding fixing screws 27', for example self-tapping screws.

Also the housing 41*b* has a through hole in its bottom wall (not visible in FIGS. 15-16) in order to enable passage of a bolt 42, which, together with a nut 43, enables fixing of the magnet 24 within the seat 41*b*. The bolt 42 and the nut 43 could also be replaced by a self-tapping screw. The magnet 24' has a shaped central hole A, in order to be able to house the head of the bolt 42. As may be noted for example in FIG. 15, in the assembled condition of the magnetic assembly 40, the front of the magnet 24' is substantially flush with the outer surface of the platelike part 41*a*, without the head of the bolt 42 projecting beyond the magnet itself.

Figure 17:
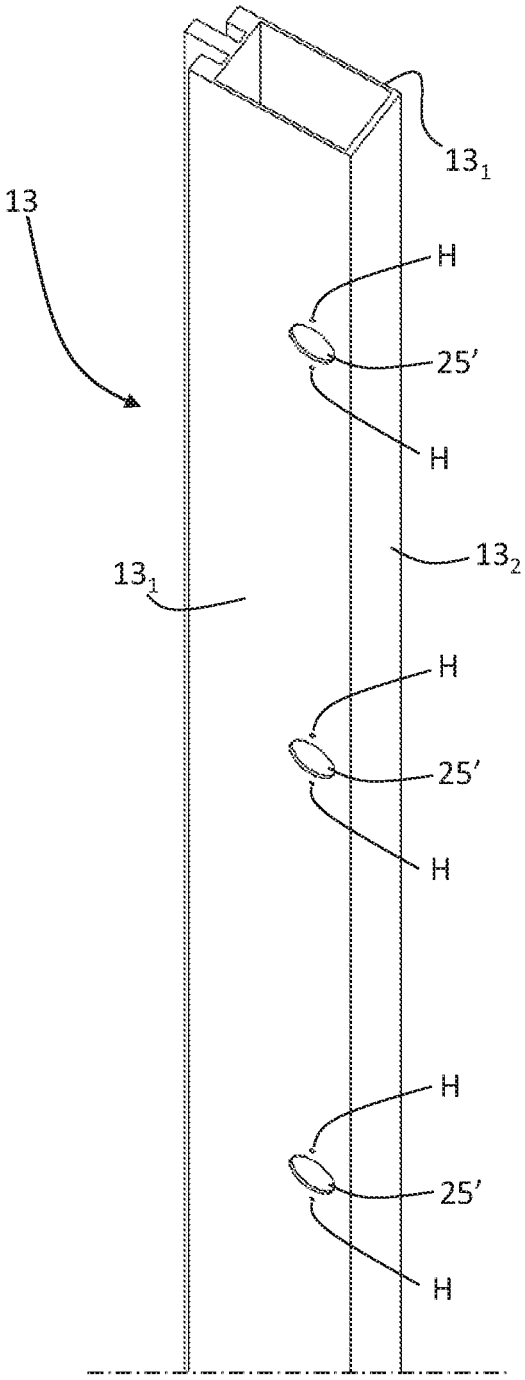
FIG. 17 is a partial and schematic perspective view of a generic commercial metal sectional element that can be used in combination with a series of adapter assemblies of the type shown in FIGS. 15-16.

Represented schematically in FIG. 17 is a portion of a generic commercial sectional element, which is here assumed as being a sectional element with a substantially quadrangular cross section designed to provide a cross member of a structural frame of the type designated previously by 10, for example an intermediate cross member 13. Provided at one of the sides of the sectional element designed to be equipped with a covering element according to the invention—here one of the two opposite major sides designated by $\mathbf{13}_1$—there is formed a series of holes 25', in number and in positions corresponding to the number and positions of the magnetic assemblies 40 that are to be mounted on the cross member 13. Preferentially, on the side $\mathbf{13}_1$ of the cross member 13 are also preventively formed holes H for the screws 27', necessary for fixing each magnetic assembly 40, in addition to the hole for application of the coupling member of the type designated previously by 32.

Figure 18:
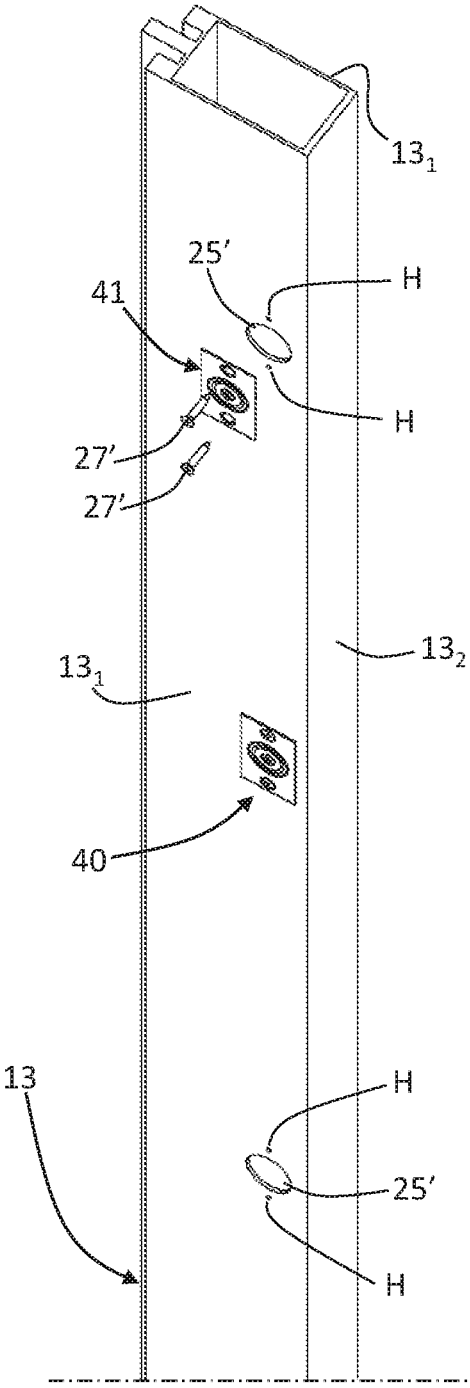
FIG. 18 is a view of the sectional element of FIG. 17, with one adapter assembly mounted and one in the course of installation.

Next, installed at each hole 25' is a corresponding assembly 40, as exemplified in FIG. 18, with the part 41*b* for housing the support 41 that is inserted in the hole and with the platelike part 41*a* of the support 41 itself that rests externally on the side $\mathbf{13}_1$ of the cross member 13. The assembly 40 is then fixed in position via the screws 27', which engage the corresponding holes H.

Figure 19:
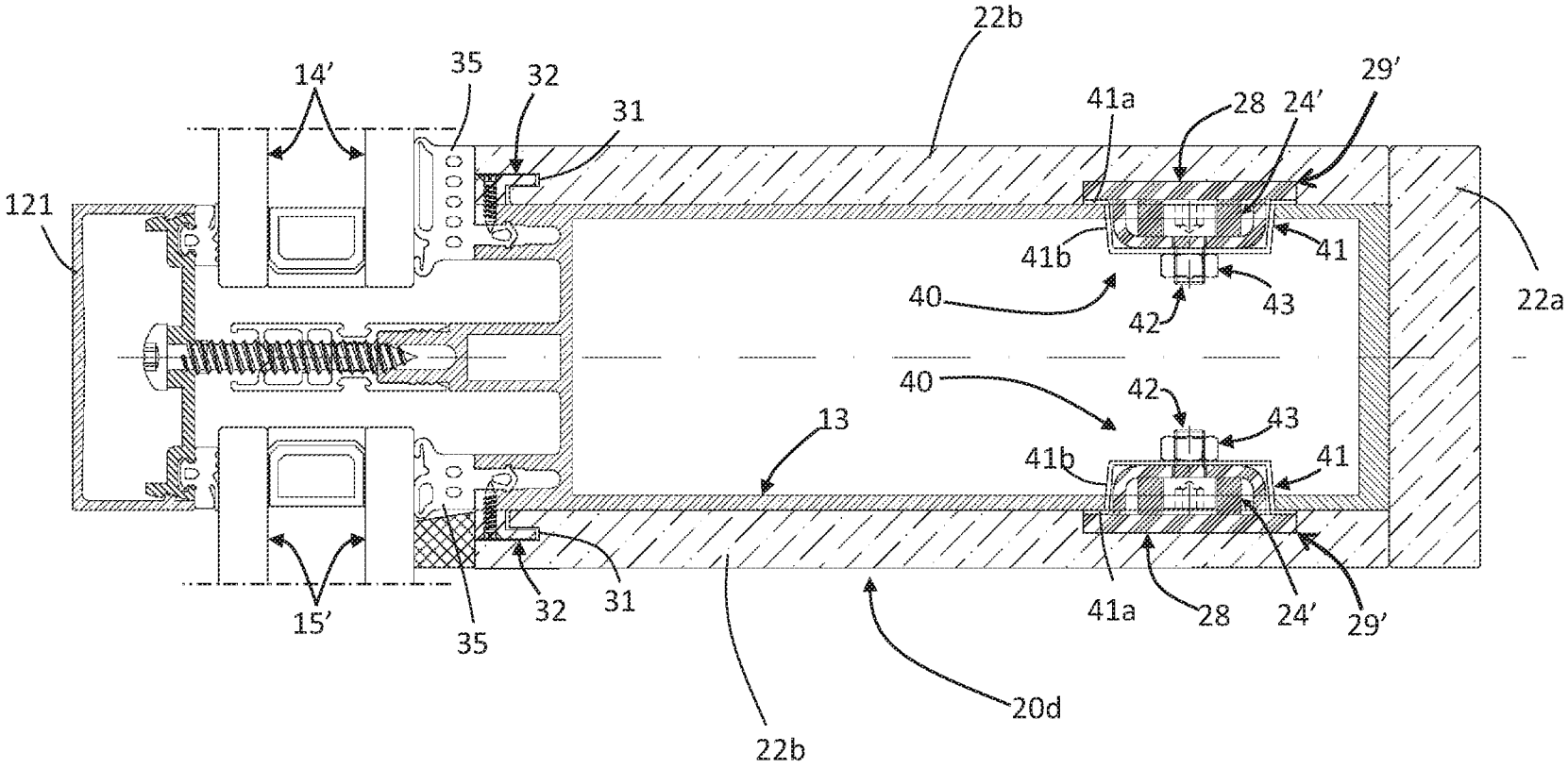
FIG. 19 is a schematic cross-sectional view of a sectional element of the type shown in FIGS. 17-18, with a kit associated thereto according to possible embodiments of the invention.

FIG. 19 exemplifies subsequent mounting of a further part of the kit on the sectional element that constitutes the cross member 13, i.e., a covering element designated as a whole by 20*d*. In the case exemplified, the covering element 20*d* has a substantially U-shaped cross section; i.e., it has a part or wall 22*a* for covering the rear side $\mathbf{13}_2$ of the sectional element and two parts or walls 22*b* substantially parallel to one another and orthogonal to the wall 22*a*, for covering the sides $\mathbf{13}_1$ of the cross member 13. Alternatively, the kit could comprise two covering elements of the type designated by 20*c* in FIG. 9.

In the case illustrated, each of the walls 22*b* of the covering element 20*d* is provided with a corresponding longitudinal seat 29' for a respective ferromagnetic element 28, in particular in the form of a groove defined on the inner side of the walls 22*b*. Preferably, as may be noted in particular from FIG. 19, the depth of the longitudinal seats 29' is greater than in the previous embodiments (i.e., greater than the thickness of the corresponding ferromagnetic element 28), so that within each seat 29' there can be received also the platelike part 41*a* of the supports 41 of the magnetic assemblies 40, thereby enabling a precise alignment between the parts involved. In the case exemplified, the walls 22*b* are provided at the front with seats 31 for mechanical constraint to the cross member 13 via respective engagement members 32, as already described previously (as an alternative, local-hooking members of the type designated previously by 32' could be used).

Figure 20:
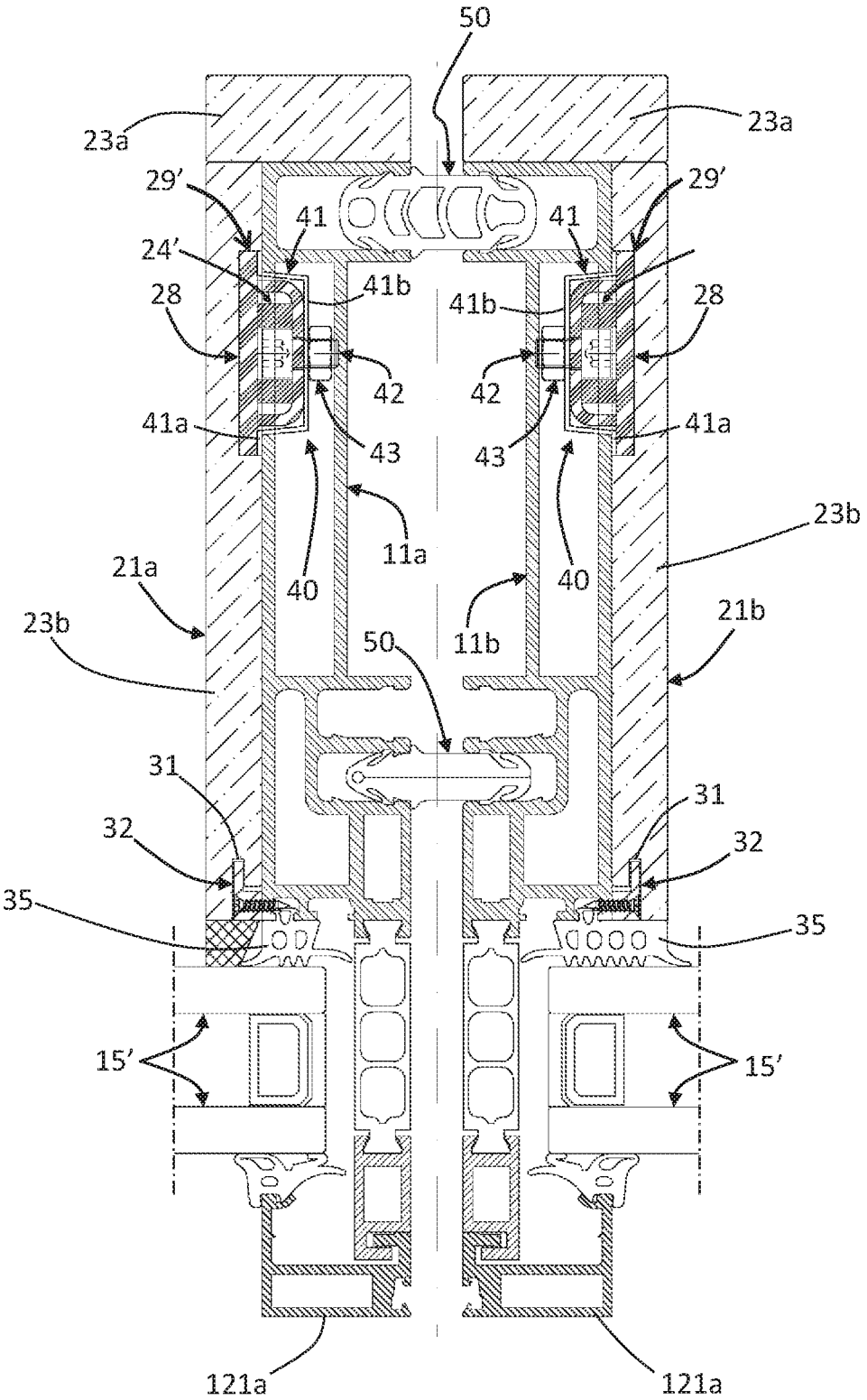
FIG. 20 is a schematic cross-sectional view of other generic commercial sectional elements assembled together and having a kit according to possible embodiments of the invention associated thereto.

FIG. 20 exemplifies mounting of further parts of a covering kit on two uprights 11*a*, 11*b* coupled laterally, but obtained from commercial or standard sectional elements. In this case, the two sectional elements in question are coupled together by means of purposely provided engagement elements, designated by 50, which are obtained in a way that is irrespective of the present invention. The modalities of mounting of the magnetic assemblies 40 on the standard sectional elements are similar to those exemplified previously with reference to FIGS. 15-18. As may be noted, in this case, the kit comprises two covering elements 21*a*, 21*b* of a conception similar to the one described with reference to FIGS. 4-7, provided with corresponding seats 29' for the respective ferromagnetic elements 28; also these seats 29' are preferentially sized for housing also the platelike part 41*a* of the supports 41 of the magnetic assemblies 40.

Also in the case exemplified in FIG. 20, the walls 23*b* of the covering elements 21*a* and 21*b* are provided at the front with seats 31 for mechanical constraint to the sectional element 13 via respective engagement members 32, as already described previously.

It will be appreciated that the concepts described in combination with FIGS. 19-20 may be used for application of a covering according to the invention also to the end cross members of a structural frame. It will moreover be appreciated that the kit, in addition or as an alternative to engagement members of the type designated previously by 32, could envisage hooking members in the form of clips or the like, for example of the same type as the clips 32' described previously with reference to FIGS. 12-14.

In possible embodiments, the covering elements may be constrained in regions that are generally opposite to, or set apart from, the respective uprights or cross members via two magnetic-coupling arrangements. Examples of this type are represented in FIGS. 21 and 22.

Figure 21:
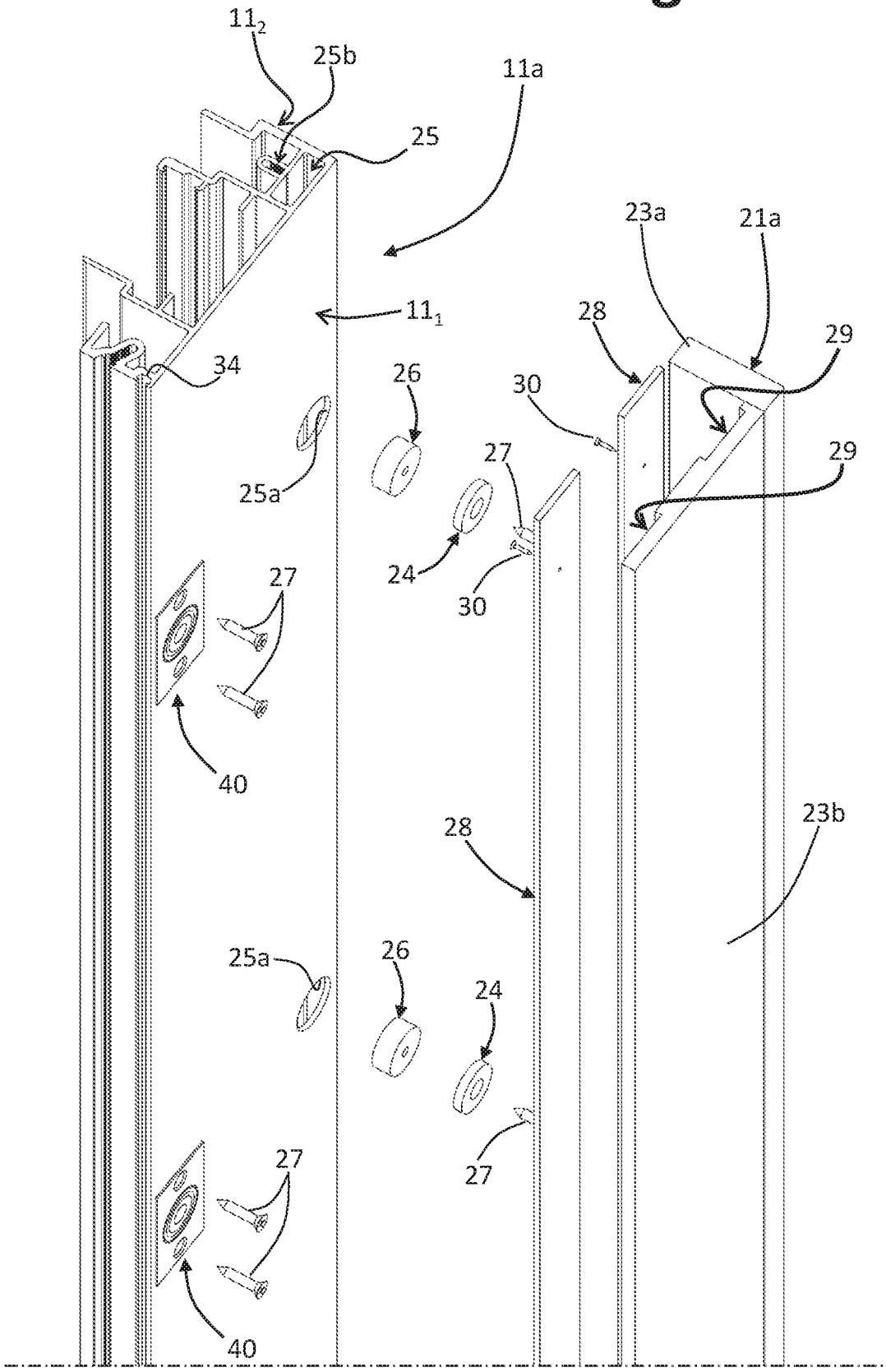

In the case of FIG. 21, as an alternative to the mechanical-coupling arrangement comprising an engagement member 32 or clips 32' of the types described previously, associated to the upright 11*a* is a second magnetic arrangement, which—in this non-limiting example—comprises a plurality of magnetic assemblies 40 of the type exemplified previously, arranged according to the direction of encumbrance in length of the upright. It should be noted that each assembly 40 does not necessarily need to be aligned transversely to a magnet 24, it also being possible for the number of magnets 24 and the number of assemblies 40 to be different.

On the other side, fixed to the inner side of the wall 23*b* of the covering element 21*a* are two ferromagnetic elements 28 of the type described previously, which extend in the longitudinal direction of the element 21*a* and are designed to co-operate with the series of magnets 24 and the series of magnetic assemblies 40, respectively. Preferably, also in this case, defined on the aforesaid inner side of the wall 23*b* are two longitudinal seats 29, each for a respective ferromagnetic elements 28.

As may be appreciated, also in solutions of this type, the covering element 21*a* is constrained in two different regions of the upright 11*a* that are generally set apart from, or opposite to, one another, here at the side $\mathbf{11}_1$ of the upright itself. In the example, the first constraint region extends in a longitudinal direction in a position closer to the corner between the sides $\mathbf{11}_1$ and $\mathbf{11}_2$ of the upright, whereas the second region extends in a longitudinal direction in a position closer to the front edge of the upright (i.e., the edge opposite to the side 112).

In the case of FIG. 22, magnets 24 and magnetic assemblies 40 are provided that are arranged in a way similar to what is illustrated in FIG. 21, but with ferromagnetic elements 28 having a different shape and positioning. In this embodiment, in fact, fixed to the inner side of the wall 23*b* of the covering element 21*a* are a plurality of ferromagnetic elements 28 (just two of which are visible) that extend in a transverse direction, each in a position corresponding to a pair of magnetic elements (i.e., a magnet 24 and a magnetic assembly 40 substantially aligned in a transverse direction or a direction of width, the number of magnets 24 and the number of assemblies 40 being in this case preferably the same). Preferably, in this case, defined on the aforesaid inner side of the wall 23*b* is a plurality of transverse seats 29, each for a respective ferromagnetic element 28. In this case, the length of the ferromagnetic elements 28 and of the possible seats 29 is smaller than in the case of FIG. 21.

Also in solutions of the type represented in FIG. 22 the covering element 21*a* is constrained in at least two different regions of the upright 11*a* generally set apart from one another. On the other hand, in this case, also each set constituted by a magnet 24, a magnetic assembly 40, and a corresponding ferromagnetic element 28 may be understood itself as an electromagnetic arrangement, provided for constraining the covering element 21*a* in a respective region of the upright 11*a*.

It will be appreciated, with reference to the embodiments exemplified in FIGS. 21 and 22, that it is also possible to envisage, in addition, a mechanical-coupling arrangement of the type referred to previously. However, this is not strictly indispensable, considering that the magnets 24 and/or 24' that can be used for the purposes of implementation of the invention have a force of magnetic attraction of several kilograms, and hence sufficient to ensure holding of the covering elements in the operating position. Indicatively, the magnets 24 and/or 24' will preferentially have a force of attraction comprised between 10 and 40 kg, very preferably between 15 and 30 kg, also according to their diameter, which may indicatively vary between 15 and 40 mm, preferably between 20 and 35 mm. Merely by way of non-limiting example, magnets suitable for the application proposed herein may be the ones identified by the codes CSN-25 and CSN-32, marketed by Webcraft GmbH, 78244 Gottmadingen, Germany, which have forces of attraction of approximately 19 kg and 30 kg, respectively, with diameters of approximately 25 mm and 32 mm, respectively.

In the case of FIGS. 21 and 22, use of magnetic assemblies 40 is exemplified, but it is clear that these assemblies could be replaced directly by magnets 24 (for example, with corresponding spacers 26 and screws 27), with a simple prearrangement of the sectional element of the structural frame (for example, providing a further seat of the type designated by 25 and corresponding holes 25*a*). It will also be appreciated that a series of magnetic elements 24 and/or 40 could be provided (also) at the side 112.

Clearly, what has been exemplified with reference to FIGS. 21 and 22 is applicable also in the case of the cross members of the structural frame and of the corresponding covering elements.

The system provided according to the invention presents evident advantages over the prior art cited in the introductory part of the present disclosure, given that the covering exemplified can be applied to the corresponding structural frames also after their installation on the building site, even in a practically final step of erection of a building.

It will be appreciated, for example, that possible surface damage to the part of the frame designed to face towards the inside of the building, which may occur during transport of the frames to the building sites, or else during their installation, or also during works of completion of the building, can be hidden from view via subsequent application of the covering proposed. The fact that the structural frames are preferentially constituted by sectional elements made of metal, in particular aluminum, does not cause damage thereto even in the event of prolonged exposure to atmospheric agents, and hence without the drawbacks typical of structural frames made of wood, as explained in the introductory part.

Yet a further advantage of the invention is represented by the fact that the sectional elements in question do not require particular surface treatments of an aesthetic nature given that the part thereof that faces towards the inside of the building is in any case covered by the purposely provided covering (on the other side, in particular in the case of curtain walls of the type represented schematically in FIGS. 1-2 and 10-11, the part of the sectional elements facing towards the outside of the building is typically covered by the infill elements).

A further substantial advantage of the invention is represented by the simplicity and speed of mounting of the covering, in particular in the case where the metal sectional elements of the frame are already prearranged for the purpose, but also in the case of adaptation of commercial or standard sectional elements, using the kit described. It will be appreciated in this regard that the use of the covering kit proposed is not limited to curtain walls of new buildings, given that it may also be applied to curtain walls that have already been existing for some time.

Finally, it will be appreciated that the system and kit according to the present invention can be used also for other types doors or window frames having a structural frame that can be provided with a covering at least in its part set facing the inside of a building.

As has been said, the elements of the covering are preferably made of wood, in particular laminated wood, but not excluded from the scope of the invention is the use of other materials, according to the aesthetic requirements that are to be achieved.

From the foregoing description the characteristics and the advantages of the present invention emerge clearly, as likewise it is clear that numerous variations may be made by the person skilled in the art to the system and kit described herein by way of example, without thereby departing from the scope of the invention as defined in the ensuing claims.

The invention claimed is:

1. A closure system for buildings openings, the closure system comprising:

at least one structural frame having at least two side uprights and two end cross members, coupled to form a perimetral structure that delimits a space, one or more infill elements associated to the structural frame at a front thereof, for closing the space delimited by the perimetral structure, one or more longitudinally extending covering elements, configured for being mounted on the structural frame at a back thereof, or a part thereof designed to be oriented towards the inside of a building, a magnetic-coupling arrangement configured for constraining in a magnetic way one said covering element at at least one first region of one said upright or cross member, wherein the magnetic-coupling arrangement comprises at least one magnet fixed in said first region of said upright or cross member, and at least one ferromagnetic element at a corresponding region of said covering element, wherein said upright or cross member has an outer wall, at least one through passage being defined in said outer wall at said first region, wherein said corresponding region comprises an inner side of said covering element facing said outer wall of said upright or cross member, wherein said magnet is at least partially set through the at least one through passage, and the ferromagnetic element is fixed at said inner side of the covering element.

2. The system according to claim 1, further comprising a mechanical-coupling arrangement configured for constraining also in a mechanical way said covering element at a second region of said upright or cross member, the mechanical coupling arrangement comprising at least one mechanical coupling member configured as a separate part with respect to said covering element and said structural frame, the at least one mechanical coupling member being elastically coupled, or else coupled via threaded elements, to said second region of said upright or cross member.

3. The system according to claim 2, wherein the covering element has:

an internal face, facing a corresponding outer face of said upright or cross member, an external face, opposite to the inner surface, and a peripheral face between the internal face and the external face, wherein a first portion of the peripheral face of the covering element extends in a position corresponding to the front of the structural frame, wherein the mechanical-coupling arrangement comprises an engagement seat defined in said first portion of the peripheral face of the covering element, and wherein a proximal portion of said at least one mechanical coupling member is configured for coupling with said engagement seat, the at least one mechanical coupling member having a distal portion configured for being secured to said upright or cross member.

4. The system according to claim 3, wherein said at least one mechanical coupling member comprises a longitudinal-engagement member, and wherein said engagement seat and said longitudinal-engagement member extend for a substantial part of a length of said covering element and of said upright or cross member, respectively.

5. The system according to claim 3, wherein said at least one mechanical coupling member comprises a plurality of local-hooking members prearranged for mounting on said covering element in a direction of length of the covering element, said local-hooking members each having the second portion thereof engageable in a corresponding seat defined at the front of said upright or cross member.

6. The system according to claim 5, wherein said corresponding seat is a seat designed for mounting a weatherstrip.

7. The system according to claim 1, comprising at least one further magnetic-coupling arrangement, configured for constraining in a magnetic way said covering element also at a further region of said upright or cross member.

8. The system according to claim 1, wherein the at least one magnet is fixed at said through passage via a threaded fixing element, the magnet having a central through hole through which the threaded fixing element extends.

9. The system according to claim 1, wherein the at least one magnetic-coupling arrangement comprises:

a plurality of said magnets, each arranged at a respective through passages of said outer wall of the upright or cross member, the through passages being spaced from one another in a longitudinal or transverse direction of said upright or cross member; and one said ferromagnetic element, which extends in a corresponding longitudinal or transverse direction at said inner side of said covering element, and which is designed to be magnetically attracted by the plurality of magnets.

10. The system according to claim 9, wherein the plurality of magnets are substantially aligned with one another in said longitudinal or transverse direction of said upright or cross member.

11. The system according to claim 1, wherein said magnet, respectively the at least one said ferromagnetic element, is set at said through passage such that a front surface thereof is substantially flush with a front surface of said outer wall of said upright or cross member.

12. The system according to claim 1, comprising a plurality of said structural frames, including at least a first structural frame and a second structural frame, wherein a side upright of the first structural frame is configured for coupling with a side upright of the second structural frame, to enable the first structural frame and the second structural frame to be coupled in an aligned configuration in a horizontal direction, or an end crossbar of the first structural frame is configured for coupling with an end crossbar of the second structural frame, to enable the first structural frame and the second structural frame to be coupled in an aligned configuration in a vertical direction.

13. A covering kit for a structural frame of a closure system for buildings openings, the covering kit comprising:

at least one longitudinally extending covering element, configured for being mounted on said structural frame on a back thereof, and at least a magnetic-coupling arrangement configured for constraining in a magnetic way said covering element at at least one first region of said structural frame, at least a mechanical-coupling arrangement configured for constraining also in a mechanical way said covering element at a further region of said structural frame, wherein said covering element has:

an internal face, configured to face a corresponding outer face of structural frame, an external face, opposite to the inner surface, and a peripheral face between the internal face and the external face, wherein a first portion of said peripheral face of said covering element extends in a position corresponding to a front of the structural frame, wherein said magnetic coupling arrangement comprises:

at least one ferromagnetic element, configured for being mounted at a first region of one of said covering element or structural frame, at least one magnetic assembly, configured for being mounted at a first region of the other one of said said covering element or structural frame, in order to co-operate with said at least one ferromagnetic element, and wherein the mechanical-coupling arrangement comprises:

an engagement seat defined in said first portion of the peripheral face of the covering element, and at least one mechanical coupling member, configured as a separate part with respect to said covering element and said structural frame, the at least one mechanical coupling member having a first part configured for fixing to said structural frame, and a second part configured for coupling with said engagement seat.

14. The kit according to claim 13, wherein said magnetic assembly comprises at least one support element defining a housing into which a respective magnet is received, the support being pre-arranged for being fixed via at least one threaded member, at a respective opening formed in said first region of said structural frame.

15. A closure system for buildings openings, the closure system comprising:

at least one structural frame having at least two side uprights and two end cross members, coupled to form a perimetral structure that delimits a space, one or more infill elements associated to the structural frame at a front thereof, for closing the space delimited by the perimetral structure, one or more longitudinally extending covering elements, configured for being mounted on the structural frame at a back thereof, or at a part thereof designed to be oriented towards the inside of a building, at least a magnetic-coupling arrangement configured for constraining in a magnetic way one said covering element at at least one first region of one said upright or cross member, at least a mechanical-coupling arrangement configured for constraining also in a mechanical way said covering element at a further region of said upright or cross member, wherein the covering element has:

an internal face, facing a corresponding outer face of said upright or cross member, an external face, opposite to the inner surface, and a peripheral face between the internal face and the external face, wherein a first portion of the peripheral face of the covering element extends in a position corresponding to the front of the structural frame, wherein the magnetic-coupling arrangement comprises at least one magnet, wherein the mechanical-coupling arrangement comprises an engagement seat defined in said first portion of the peripheral face of the covering element, and wherein the mechanical-coupling arrangement moreover comprises at least one mechanical coupling member, configured as a separate part with respect to said covering element and said structural frame, the at least one mechanical coupling member being secured to said further region of said upright or cross member, with a coupling part thereof which is coupled to said engagement seat.

16. The closure system according to claim 15, wherein:

said upright or cross member is made of aluminium, or an aluminium-based alloy, or a material not attracted by a magnet, the magnetic-coupling arrangement also comprises at least one ferromagnetic element, and one of said magnet and said ferromagnetic element is secured at said first region of said upright or cross member, and the other one of said magnet and ferromagnetic element is secured at a corresponding first region of said covering element.

17. The closure system according to claim 16, wherein:

said upright or cross member has an outer wall, at least one through passage being defined in said outer wall at said first region, said corresponding first region comprises an inner side of said covering element facing said outer wall of said upright or cross member, and said magnet is at least partially set through the at least one through passage, and the ferromagnetic element is fixed at said inner side of the covering element.

18. The system according to claim 17, wherein the magnetic-coupling arrangement comprises:

a plurality of said magnets, each arranged at a respective through passages of said outer wall of the upright or cross member, the through passages being spaced from one another in a longitudinal or transverse direction of said upright or cross member; and one said ferromagnetic element, which extends in a corresponding longitudinal or transverse direction at said inner side of said covering element, with which the plurality of magnets is designed to co-operate.

19. The system according to claim 18, wherein the plurality of magnets are substantially aligned with one another in said longitudinal or transverse direction of said upright or cross member.

20. The system according to claim 17, wherein said magnet is set at said through passage such that a front surface thereof is substantially flush with a front surface of said outer wall of said upright or cross member.

* * * * *